US011051548B2

(12) United States Patent
Alarcon et al.

(10) Patent No.: US 11,051,548 B2
(45) Date of Patent: Jul. 6, 2021

(54) DEVICE FOR STORING AND VAPORIZING LIQUID MEDIA

(71) Applicant: Fontem Holdings 4 B.V., Amsterdam (NL)

(72) Inventors: Ramon Alarcon, Los Gatos, CA (US); Dennis Rasmussen, Campbell, CA (US); Alex Tittiger, San Francisco, CA (US)

(73) Assignee: FONTEM HOLDINGS 4 B.V., Amsterdam (NL)

( * ) Notice: Subject to any disclaimer, the term of this patent is extended or adjusted under 35 U.S.C. 154(b) by 0 days.

(21) Appl. No.: 16/808,231

(22) Filed: Mar. 3, 2020

(65) Prior Publication Data

US 2020/0196666 A1 Jun. 25, 2020

Related U.S. Application Data

(63) Continuation of application No. 16/524,471, filed on Jul. 29, 2019, which is a continuation of application No. 15/996,124, filed on Jun. 1, 2018, now Pat. No. 10,405,585, which is a continuation of application No. 14/857,768, filed on Sep. 17, 2015, now Pat. No. 9,986,762.

(60) Provisional application No. 62/051,812, filed on Sep. 17, 2014.

(51) Int. Cl.

| | |
|---|---|
| ***A24F 13/00*** | (2006.01) |
| ***A24F 40/40*** | (2020.01) |
| ***A24F 40/42*** | (2020.01) |
| ***A24F 40/44*** | (2020.01) |
| ***A24F 40/46*** | (2020.01) |
| *A24F 40/10* | (2020.01) |

(52) U.S. Cl.
CPC ..... *A24F 40/40* (2020.01); *A24F 40/42* (2020.01); *A24F 40/44* (2020.01); *A24F 40/46* (2020.01); *A24F 40/10* (2020.01)

(58) Field of Classification Search
CPC ..... A24F 47/008
USPC ..... 131/329, 271, 273
See application file for complete search history.

(56) References Cited

U.S. PATENT DOCUMENTS

| | | | | |
|---|---|---|---|---|
| 1,818,290 A * | 8/1931 | Wulle | H01R 13/707 | 200/50.3 |
| 4,553,000 A * | 11/1985 | Appleton | H01R 13/629 | 200/50.29 |
| 5,680,926 A * | 10/1997 | Sandor | H01R 13/625 | 200/50.11 |
| 5,741,149 A * | 4/1998 | Anthony | H01R 13/707 | 439/314 |
| 5,880,420 A * | 3/1999 | Rohmer | H01R 13/707 | 200/50.28 |
| 6,255,607 B1 * | 7/2001 | Miller | H01R 13/707 | 200/50.29 |

(Continued)

FOREIGN PATENT DOCUMENTS

| | | |
|---|---|---|
| CN | 203424288 U | 2/2014 |
| CN | 203555161 U | 4/2014 |

*Primary Examiner* — Abdullah A Riyami
*Assistant Examiner* — Nelson R. Burgos-Guntin
(74) *Attorney, Agent, or Firm* — Perkins Coie LLP; Kenneth H. Ohriner

(57) ABSTRACT

A device for storing and vaporizing liquid media can comprise an annular liquid media storage tank and a heater configured to vaporize liquid stored in the annular liquid media storage tank.

17 Claims, 24 Drawing Sheets

(56) References Cited

U.S. PATENT DOCUMENTS 6,368,133 B1* 4/2002 Zeiler ..... H01R 13/625 439/321
6,376,785 B1* 4/2002 Graninger ..... H01H 13/503 200/329
6,410,868 B1* 6/2002 Berlemont ..... H01R 13/707 200/50.28
7,537,472 B1* 5/2009 Schwarz ..... H01R 13/527 439/188
8,528,569 B1 9/2013 Newton
8,794,231 B2 8/2014 Thorens et al.
9,472,908 B2* 10/2016 Shendge ..... H01R 13/639
2013/0180533 A1* 7/2013 Kim ..... A24F 47/008 131/273
2013/0192615 A1* 8/2013 Tucker ..... H05B 1/0244 131/328
2013/0192618 A1 8/2013 Li et al.
2013/0213419 A1* 8/2013 Tucker ..... H05B 3/141 131/328
2013/0228191 A1 9/2013 Newton et al.
2013/0263869 A1 10/2013 Zhu
2014/0060555 A1* 3/2014 Chang ..... A24F 47/008 131/329
2014/0096782 A1* 4/2014 Ampolini ..... A24F 47/008 131/328
2014/0123989 A1 5/2014 Lamothe
2014/0190503 A1 7/2014 Li et al.
2014/0238423 A1* 8/2014 Tucker ..... A24F 47/008 131/328
2014/0261489 A1* 9/2014 Cadieux ..... A24F 47/008 131/328
2014/0261493 A1* 9/2014 Smith ..... A24F 47/008 131/328
2015/0020823 A1* 1/2015 Lipowicz ..... A24F 40/20 131/328
2015/0020830 A1* 1/2015 Koller ..... A24F 47/008 131/329
2015/0027454 A1* 1/2015 Li ..... A61M 11/044 131/328
2015/0083147 A1* 3/2015 Schiff ..... A24F 40/44 131/329
2015/0090278 A1* 4/2015 Schiff ..... A24F 47/008 131/328
2015/0136158 A1* 5/2015 Stevens ..... H02J 7/0091 131/329
2015/0144145 A1 5/2015 Chang et al.
2015/0208728 A1* 7/2015 Lord ..... A24F 7/00 131/329
2015/0208731 A1* 7/2015 Malamud ..... H05B 1/0244 131/328
2015/0245669 A1* 9/2015 Cadieux ..... A61M 15/06 131/329
2015/0257445 A1* 9/2015 Henry, Jr. ..... A24F 47/008 131/328
2015/0335075 A1 11/2015 Minskoff et al.
2015/0366265 A1* 12/2015 Lansing ..... A24F 47/004 131/329
2016/0073692 A1* 3/2016 Alarcon ..... A24F 47/008 131/329
2016/0374394 A1* 12/2016 Hawes ..... A24F 1/32 131/329

* cited by examiner

DEVICE FOR STORING AND VAPORIZING LIQUID MEDIA

CROSS-REFERENCE TO RELATED APPLICATION(S)

This application is a continuation of U.S. patent application Ser. No. 16/524,471, filed Jul. 29, 2019, which is a continuation of U.S. patent application Ser. No. 15/996,124, filed Jun. 1, 2018, now U.S. Pat. No. 10,405,585, which is a continuation of U.S. patent application Ser. No. 14/857,768, filed Sep. 17, 2015, now U.S. Pat. No. 9,986,762, which claims the benefit of and priority to U.S. provisional patent application No. 62/051,812 filed Sep. 17, 2014. These applications are incorporated herein by reference.

BACKGROUND a. Field of Disclosure

This disclosure relates to a device for storing and vaporizing liquid media.

b. Background Art

Electronic cigarettes are a popular alternative to traditional smoking articles that burn tobacco products to generate mainstream smoke for inhalation. Unlike traditional tobacco-based smoking articles, electronic cigarettes generate an aerosol-based vapor for inhalation, which can generally emulate mainstream smoke of traditional tobacco based smoking articles. However, it is generally recognized that aerosol-based vapor generated by electronic cigarettes may not deliver the same "quality" of experience as traditional smoking articles.

Generally, a porous material can store the liquid media, which can be drawn to an atomizer, such as a heated coil. Upon contact between the liquid media and the heated coil, the liquid media can be atomized to form a vapor that is inhaled by the user. As liquid media stored in the porous material is used up, liquid media that is stored within a close proximity to the atomizer can be wicked from the porous media. In contrast, liquid media stored in the porous material at a further proximity to the atomizer may not be wicked to the atomizer because the liquid media has to travel a further distance through the porous media. As a result, the amount of liquid media wicked to the atomizer may decrease even when additional liquid media is stored in the porous media. This can cause the user to experience a drop-off in the "quality" of their experience, because less vapor is produced by the atomizer. This can give the user an impression that the porous material has been depleted of remaining liquid, causing the user to discard the porous material when some amount of liquid media remains.

SUMMARY

In various embodiments, a device for storing and vaporizing liquid media can comprise an outer tube mounted around at least a portion of an inner tube, wherein the outer tube comprises an outer surface and an inner surface, wherein the inner tube comprises an inner surface defining an air path and an outer surface, and wherein an annular liquid media storage tank is defined between the outer surface of the inner tube and the inner surface of the outer tube. A mouth piece can be connected to a proximal end of the inner tube and to the outer tube. A heater coil casing can define a heater coil chamber, in which a heater coil can mounted at least partially within. A wick can extend through a center of the heater coil and through a first port in a first wall of the heater coil casing and through a second port in a second wall of the heater coil casing, wherein a first end portion of the wick extends into a first individual recessed pocket in the annular liquid media storage tank, and wherein a second end portion of the wick extends into a second individual recessed pocket in the annular liquid media storage tank.

In various embodiments, a cartomizer for an electronic cigarette can comprise an outer tube mounted around at least a portion of an inner tube, wherein the outer tube comprises an outer surface and an inner surface, wherein the inner tube comprises an inner surface defining an air path and an outer surface, and wherein an annular liquid media storage tank is defined between the outer surface of the inner tube and the inner surface of the outer tube. A mouth piece can be connected to a proximal end of the inner tube and to the outer tube. A heater coil casing can define a heater coil chamber comprising (i) an upper heater coil housing further defining a housing air outlet connected with a distal end of the inner tube and (ii) a lower heater coil housing further defining a housing air inlet. A heater coil can be mounted at least partially within the heater coil casing between the housing air outlet and the housing air inlet. A wick can extend through a center of the heater coil and through a first port in a first wall of the heater coil casing and through a second port in a second wall of the heater coil casing, wherein a first end portion of the wick extends into a first individual recessed pocket in the annular liquid media storage tank, and wherein a second end portion of the wick extends into a second individual recessed pocket in the annular liquid media storage tank.

In various embodiments, an electronic cigarette can comprise an outer tube comprising an outer surface and an inner surface. An inner tube can be mounted within the outer tube, wherein the inner tube comprises an inner surface defining an air pathway, an outer surface, a proximal end, and a distal end. The electronic cigarette can comprise an annular liquid media storage tank comprising an inner cylindrical wall and an outer cylindrical wall, wherein the inner cylindrical wall of the storage tank comprises at least a portion of the outer surface of the inner tube, and wherein the outer cylindrical wall of the storage tank comprises at least a portion of the inner surface of the outer tube. The electronic cigarette can comprise a heater coil casing defining a heater coil chamber and comprising (i) an upper heater coil housing defining a housing air outlet connected with a distal end of the inner tube, wherein the distal end of the inner tube is inserted into the housing air outlet; and (ii) a lower heater coil housing defining a housing air inlet. A heater coil can be mounted between the housing air outlet and the housing air inlet. A wick can extend through a first port and a second port in a sidewall of the heater coil casing and into a recessed pocket of the storage tank. A mouth piece can be connected with the outer tube and the proximal end of the inner tube. The electronic cigarette can comprise an outer surface connected with the inner surface of the outer tube.

DETAILED DESCRIPTION

Figure 1C:
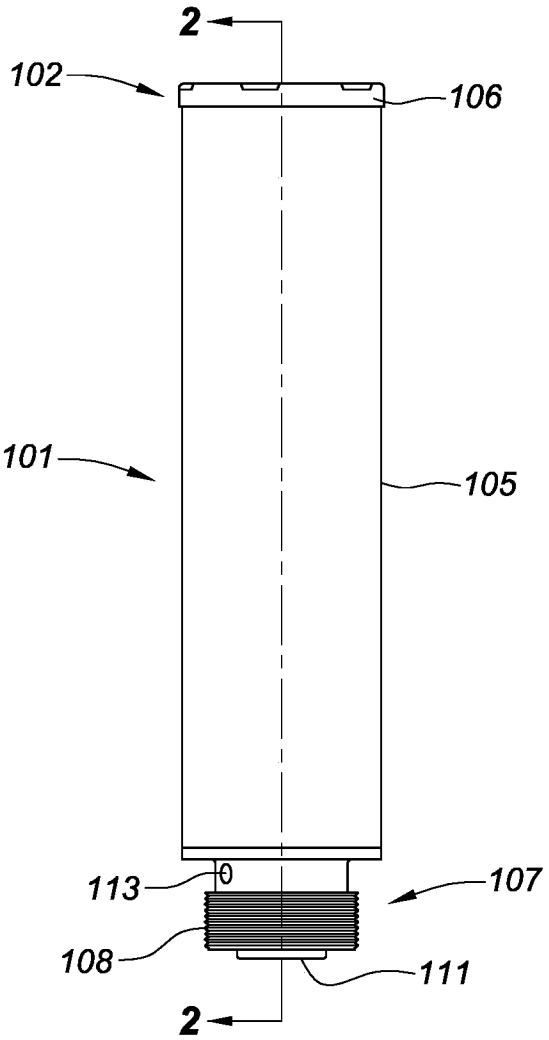
FIG. 1C depicts a side-view of the device in FIG. 1A, in accordance with embodiments of the present disclosure.
Figure 1B:
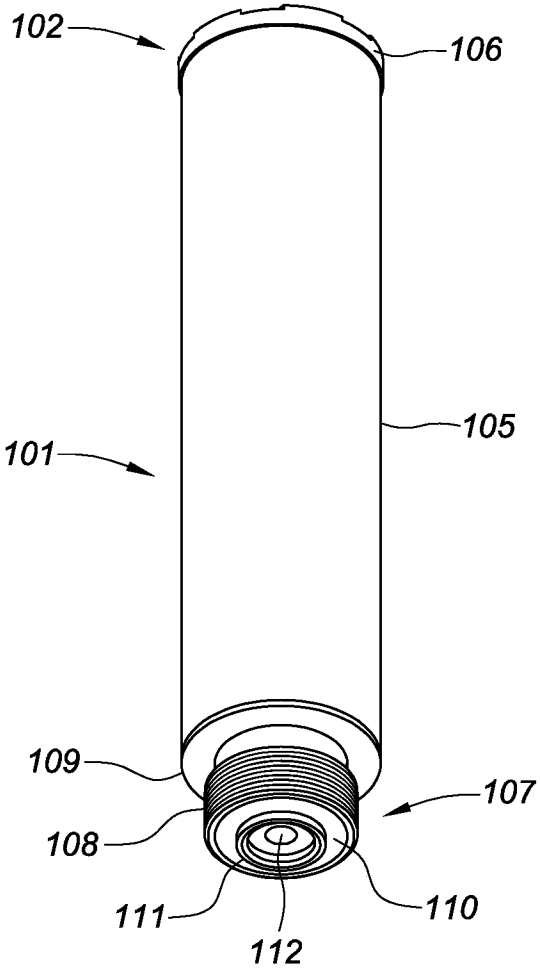
FIG. 1B depicts an isometric bottom and side view of the device in FIG. 1A, in accordance with embodiments of the present disclosure.
Figure 1A:
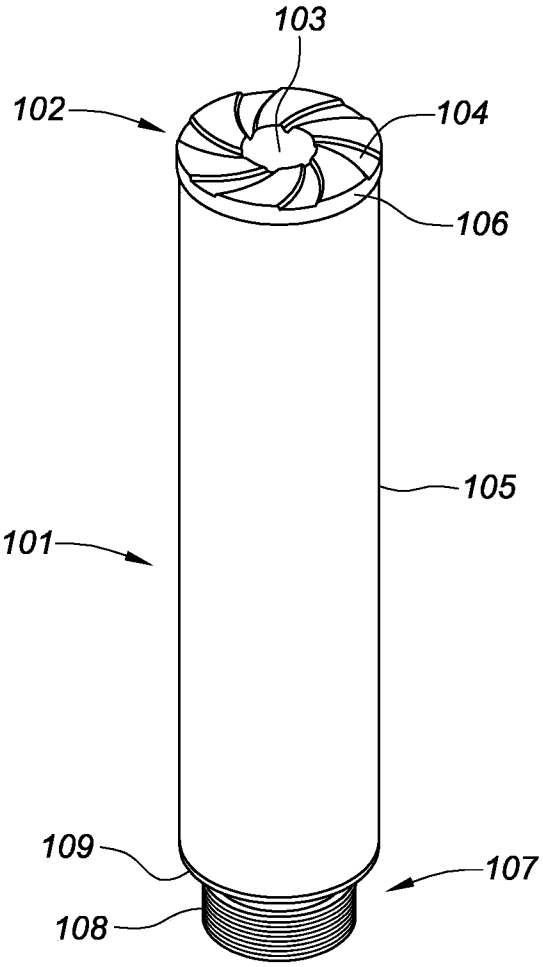
FIG. 1A depicts an isometric top and side view of a device for storing and vaporizing liquid media, in accordance with embodiments of the present disclosure.

Referring now to the drawings wherein like reference numerals are used to identify identical components in the various views, FIG. 1A is an isometric top and side view of a device 101 for storing and vaporizing liquid media, in accordance with embodiments of the present disclosure. In an example, the device 101 can be a cartomizer for an electronic cigarette, which can be connected with a power source (e.g., battery) to provide power for an atomizer contained within the device 101. The device 101 can include a mouth piece 102 with an outlet 103, which can be configured for delivery of a vapor to a user.

The mouth piece 102 can be sized and configured to provide a user with a particular type of experience. For instance, adjusting a size and/or shape of the outlet 103 and/or a passageway within the mouthpiece, shown in FIG.

3, can result in a change in velocity of vapor exiting the outlet 103 and/or a change in particle size of the liquid media contained in the vapor. As such, a different user experience can be associated with the change in velocity and/or particle size. For example, the vapor exiting the outlet 103 may feel different to a user when it enters their mouth, as a result of the change in velocity and/or particle size. In some examples, the mouth piece 102 can comprise a pattern 104, which can be associated with a particular user experience associated with the mouth piece 102 and/or device 101. The pattern 104 can be used by a user to identify the particular user experience associated with the mouth piece 102 and/or device 101.

The device 101 can include an outer tube 105 that is connected with the mouth piece 102. In an example, the mouth piece 102 can be connected with the outer tube 105 by press-fitting the mouth piece 102 into the outer tube 105 and/or through use of an adhesive applied between the outer tube 105 and the mouth piece 102, although other connecting technologies may be used. In some embodiments, the mouth piece 102, as well as other components of the device 101, can be connected with the outer tube 105 via a snap connector, as discussed herein. The mouth piece 102 can include a stepped portion 106 (or annular ledge) that can engage the proximal longitudinal end of the outer tube 105 to prevent the mouth piece 102 from being pushed into the outer tube further than a defined amount.

The device 101 can include a battery connector 107 (e.g., a threaded connector as shown or a frictionally-engaged connector or other connector) that is configured to connect with a complementary connector comprising part of or associated with a housing for a battery or other power source that is capable of providing power to an atomizer comprising part of the device 101. In an example, the battery connector 107 can be connected with the outer tube 105 by press-fitting the battery connector 107 into the outer tube 105 and/or, for example, through use of an adhesive applied between the outer tube 105 and the battery connector 107. The battery connector 107 can include a stepped portion 109 (or annular ledge), much like the mouth piece 102 that can engage the distal longitudinal end of the outer tube 105 to prevent the battery connector 107 from being pushed into the outer tube 105 further than a defined amount.

The battery connector 107 can establish both a physical connection between the device 101 and a housing for a power source and an electrical connection between the power source (e.g., the battery in the housing) and the device 101. In an example, the physical connection can be established by a first threaded portion 108, which can be configured to threadingly connect with a complimentary threaded portion associated with the battery. The first threaded portion 108 of the connector 107 can be constructed from an electrically conductive material (e.g., metal). The connector 107 may further comprise, for example, a center connector 111, which may also be constructed from an electrically conductive material. As discussed further below, the first threaded portion 109 and the center connector 111 may be electrically insulated from each other by an annular insulator grommet 110. Thus, the connector 107, via the first threaded portion 108 and the center connector 111, can facilitate an electrical connection between a first terminal (e.g., positive terminal) and a second terminal (e.g., negative terminal) of the battery.

FIG. 1B is an isometric bottom and side view of the device 101 in FIG. 1A, in accordance with embodiments of the present disclosure. The device 101 includes the mouth piece 102, the stepped portion 106 of the mouth piece 102, the outer tube 105, the battery connector 107, the threaded portion 108 of the battery connector 107, and the stepped portion 109 of the battery connector 107. FIG. 1B further illustrates details associated with the battery connector 107, which can include an annular insulator grommet 110 that is inserted into an axial cylindrical opening of the battery connector 107. The annular insulator grommet 110 can include an axial cylindrical opening, in which a center battery connect 111 can be inserted. The annular insulator grommet 110 can be formed from an insulative material that separates the center battery connect 111 from the threaded portion 108 and/or stepped portion 109. For example, the annular insulator grommet 110 can be formed of a plastic, rubber, ceramic, etc., which can prevent a short from occurring between the center battery connect 111 and the threaded portion 108 and/or stepped portion 109.

In some embodiments, the center battery connect 111 can include an axial cylindrical opening 112 in the center battery connect 111 that is in communication with the inner surface of the inner tube 118. In an example, a first terminal of the battery can be connected with the threaded portion 108 and/or stepped portion 109 and a second terminal of the battery can be connected with the center battery connect 111. For instance, a positive terminal of the battery can connect to the threaded portion 108 and/or stepped portion 109 and a negative terminal of the battery can connect to the center battery connect 111.

FIG. 1C is a side-view of the device 101 in FIG. 1A, in accordance with embodiments of the present disclosure. The device 101 includes the mouth piece 102 with stepped portion 106. The mouth piece 102 can be connected with the outer tube 105 and can include stepped portion 106. In addition, the device 101 can include battery connector 107 that has a threaded portion 108 and stepped portion 109. The battery connector 107 can include an axial cylindrical opening in which an insulator grommet 110 (as shown in FIG. 1B) can be inserted to provide an insulative layer between a center battery connect 111 inserted in an axial cylindrical opening of the insulator grommet 110 and the threaded portion 108 of the battery connector 107. In addition, the device 101 can include an air inlet 113 through which air can be drawn into the device 101. In some embodiments, the device 101 can include more than one air inlet 113. For example, air can be drawn through an axial cylindrical opening of the center battery connect 111.

Figure 1D:
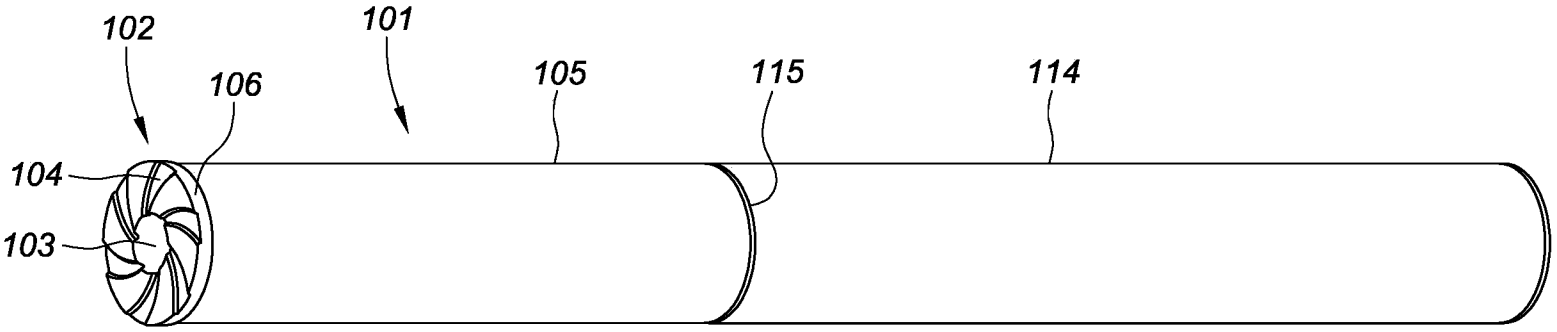
FIG. 1D depicts an isometric top and side view of an electronic cigarette, in accordance with embodiments of the present disclosure.

FIG. 1D is an isometric top and side view of an electronic cigarette, in accordance with embodiments of the present disclosure. The electronic cigarette includes a device 101 that is connected with a battery assembly 114. The battery assembly 114 can include a power source (e.g., battery) that is used to power a heater coil housed in the device 101, as discussed herein. The connection between the device 101 and the battery assembly 114 can be a threaded connection and/or a frictionally-engaged connection or other type of connection that is configured to connect the device 101 and the battery assembly 114. In an example, the threaded connection can include a first threaded portion on the device 101 and a complimentary threaded portion on the battery assembly 114. The frictionally-engaged connection can include two complementary connectors that are configured to frictionally engage one another, as discussed herein. Upon connection of the device 101 and the battery assembly 114, a joint 115 can be formed between the device 101 and the battery assembly 114.

FIG. 1D further depicts the mouth piece 102 of the device 101. The mouth piece 102 includes the outlet 103 where vapor exits the electronic cigarette, as a user draws from the mouth piece 102. As discussed herein, the stepped portion 106 of the mouth piece 102 can engage the proximal end of the outer tube 105, thus preventing the mouth piece 102 from being pushed into the outer tube 105 further than a defined amount. In addition, the mouth piece 102 can comprise the pattern 104, such that a user can identify the particular user experience associated with the mouth piece 102 and/or device 101.

In some embodiments, the battery assembly 114 can include a light assembly 116 on a tip of the battery assembly 114 distal to the device 101. The light assembly 116 can include a light filter and a light emitting diode (LED). As a user draws on the mouth piece 102, the LED can generate light which passes through the light filter. In an example, the light filter can disperse the light generated by the LED and/or can impart a particular color to the light generated by the LED.

Figure 2:
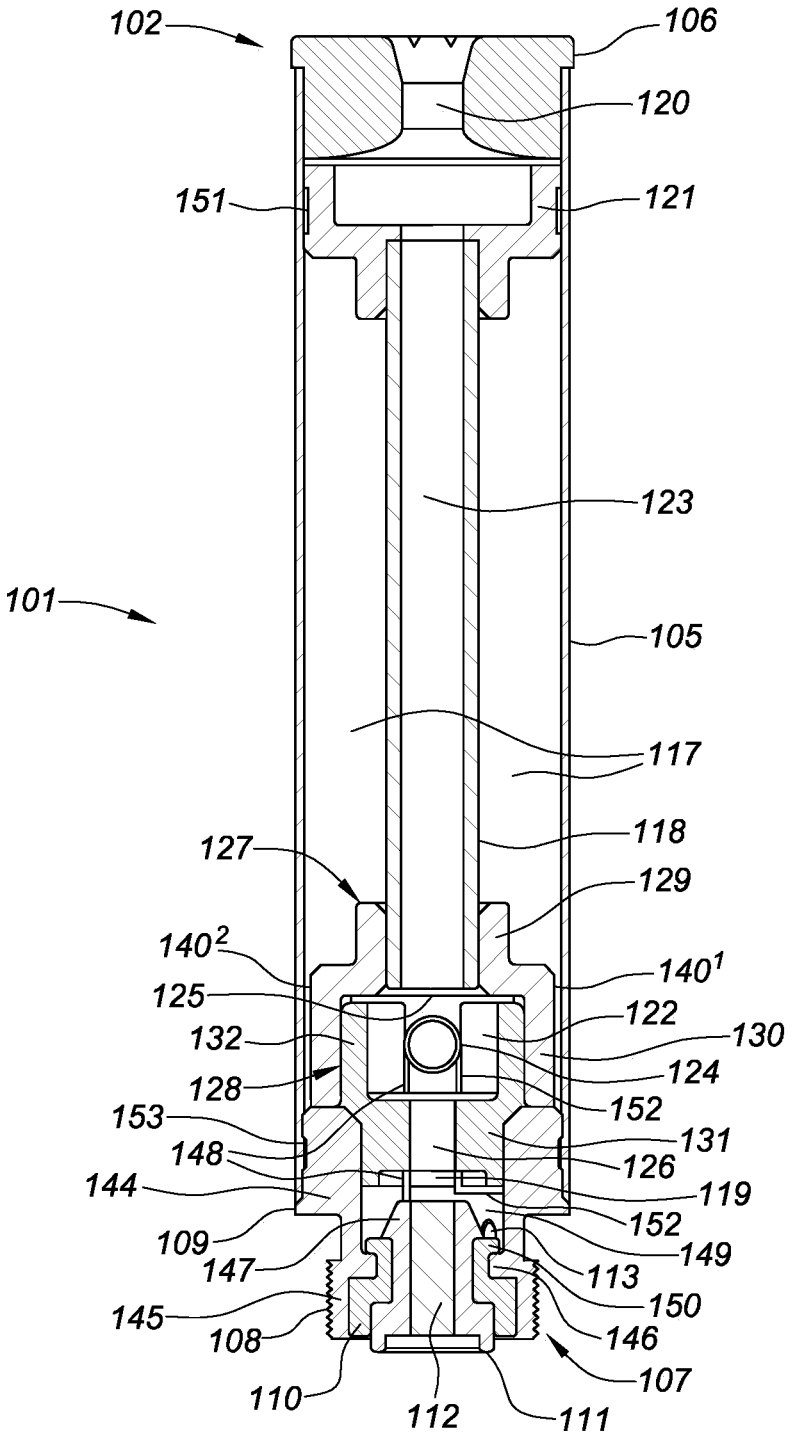
FIG. 2 depicts a cross-sectional view of the device of FIG. 1C taken along line 2-2, in accordance with embodiments of the present disclosure.

FIG. 2 is a cross-sectioned view of the device 101 of FIG. 1C taken along line 2-2, in accordance with embodiments of the present disclosure. The device 101 can include a liquid media storage tank 117 that can be configured to hold a liquid media. In an example, the liquid media can include a smoking liquid that can be vaporized by an atomizer and inhaled by a user. The liquid media can include a flavoring and/or nicotine to enhance a user's experience. The liquid media storage tank 117 can be annular in shape and can be defined by an outer surface of an inner tube 118 and an inner surface of an outer tube 105.

In some embodiments, the inner tube 118 and/or the outer tube 105 can be annular in shape. In some embodiments, the outer tube 105 can be mounted around at least a portion of the inner tube 118. The inner tube 118 and the outer tube 105 can be connected with a mouth piece 102, in some embodiments. As such, vapor can travel through an air path 123 defined by an inner surface of the inner tube 118 through a passageway 120 formed in the mouth piece 102. In addition, by connecting the outer tube 105 to the mouth piece 102, a proximal end of the liquid media storage tank 117 can be sealed by a connection between the outer tube 105 and the mouth piece 102 and a connection between the inner tube 118 and the mouth piece 102. Alternatively, in some embodiments, a proximal seal 121 can be placed between the inner tube 118 and the mouth piece 102, as illustrated in FIG. 2. In an example, the proximal seal 121 can have an outer surface that connects with an inner surface of the outer tube 105 and can have an inner surface that connects with an outer surface of the inner tube 118, thus sealing the proximal end of the liquid storage media tank 117.

In some embodiments, the proximal seal 121 and the outer tube 105, and/or other portions of the device 101 (e.g., mouth piece 102 and outer tube 105, inner tube 118 and proximal seal 121, heater coil housing (or upper heater coil housing) 127 and heater coil support (or lower heater coil housing) 128, outer tube 105 and battery connector 107, etc.) can be connected via snap connectors 151, 153. The snap connectors 151, 153 can include a lip portion and a corresponding recessed portion that engage one another. In an illustrative example, when the proximal seal 121 has been inserted into the outer tube 105 an appropriate amount, the lip portion and the corresponding recessed portion can engage one another, as discussed further in relation to FIG. 5.

Alternatively, and/or in addition, elements 151, 153 can represent seals. In an example, the upper seal 121 and/or battery connector 107 can have an annular groove extending around an outer perimeter between an inside of the outer tube and the upper seal 121 and/or between the inside of the outer tube and the upper seal 121. Each groove can have a proximal wall and a distal wall and material between the proximal wall and the distal wall can be removed to form the groove. In some examples, a seal can be placed in the grooves between the proximal wall and distal wall. For instance, an annular seal can be placed in the grooves and when the upper seal 121 and/or the battery connector 107 is inserted into the outer tube, the seal can be deformed and compressed between the battery connector 107 and the outer tube 105 and the upper seal 121 and the outer tube 105. Thus, a seal can be created between the battery connector 107 and the outer tube 105 and/or between the upper seal 121 and the outer tube 105.

In some embodiments, a distal end of the inner tube 118 can be connected with a chamber air outlet (or housing air outlet) 125 of a heater coil chamber 122. The heater coil chamber 122 can include a chamber that houses a heater coil 124, a chamber air inlet (or housing air inlet) 126, and the chamber air outlet 125. In an example, the heater coil 124 can vaporize liquid media drawn from liquid media storage tank 117, which can be mixed in the heater coil chamber 122 with air received from the chamber air inlet 126. The mixture of vapor and air can then be drawn through the chamber air outlet 125, through the inner tube 118 and passageway 120 of the mouth piece 102.

The heater coil chamber 122 can be formed by a heater coil housing (or upper heater coil housing) 127 that includes the chamber air outlet 125 and a heater coil support (or lower heater coil housing) 128 that includes the chamber air inlet 126. In some embodiments, the heater coil housing 127 and the heater coil support 128 can form a heater coil casing, which defines the heater coil chamber. In an example, together, the heater coil housing 127 and the chamber coil support 128 can form the heater coil chamber 122. The heater coil housing 127 can be annular in shape and can include a neck portion 129 and a base portion 130. The neck portion 129 can have an inner diameter that is less than an inner diameter of the base portion 130 and can be configured to receive/connect with the distal end of the inner tube 118. Forming the inner tube 118 and the heater coil housing 127 as separate components can be advantageous when different lengths of the device 101 are produced. For example, in contrast to prior methods that form the inner tube and heater coil housing/heater coil chamber from one piece, if various sizes of electronic cigarettes are produced, a longer/shorter inner tube 118 may be used, rather than producing a new one piece assembly that includes a heater coil housing and an inner tube of a different length.

The heater coil support 128 can be annular in shape and can include a neck portion 131 and a base portion 132. In some embodiments, an outer diameter of the base portion 132 of the heater coil support 128 can be less than an inner diameter of the base portion 130 of the heater coil housing 127. The base portion 132 of the heater coil support 128 can be inserted into the base portion 130 of the heater coil housing 127 and connected with the base portion 130 of the heater coil housing 127. The heater coil housing 127 and the heater coil support 128 define the heater coil chamber 122 between the chamber air inlet 126 and the chamber air outlet 125.

Some embodiments of the present disclosure can include a removable flavoring pack. In an example, juice can be included in the liquid media storage tank 117, which contains nicotine. Flavoring can be contained in a separate pack that can be attached to the device 101. As such, when a user draws from the device 101, flavoring can be introduced into the air path that travels through the device. In some examples, the mouth piece 102 can be detachable and a flavor pack can be inserted upstream (distal) from the mouth piece 102. In an example, a flavor pack can be inserted between the battery connector 107 and the battery assembly.

In some embodiments, the flavoring pack can include electrical contacts on either end of the flavoring pack that connect the coil 124 to the battery assembly. The flavoring pack can include an electrical lead that connects the center battery connect 111 to a corresponding terminal of the battery assembly. In addition, the flavoring pack can include an additional electrical lead that connects the neck portion 145 of the battery connector 107 to a corresponding terminal of the battery assembly.

In some embodiments, the flavoring pack can include a hole that passes longitudinally through the flavoring pack and connects the axial cylindrical opening 112 to a corresponding axial cylindrical opening of the battery assembly. An annular flavoring tank can surround the hole that passes longitudinally through the flavoring pack, and can be formed by an inner and outer cylindrical wall. In some embodiments, the flavoring pack can contain one or more orifices passing through the inner cylindrical wall, such that flavoring juice can pass from the annular tank and into the hole that passes longitudinally through the flavoring pack. In an example, as a user draws on the device 101, a pressure differential can be created between an interior portion of the annular tank and the hole that passes longitudinally through the flavoring pack. Thus, flavoring juice can be drawn from the flavoring pack into the hole and travel proximally through the device and be inhaled by the user.

In some embodiments, media can be placed in the hole of the flavor pack that absorbs the flavoring, as the flavoring is drawn from the tank through the orifices. In an example, the media can be a cotton like media and/or a porous media. As air passes over the media that contains the absorbed flavoring, the flavoring can be evaporated. In some embodiments, the media can increase a rate at which the flavoring juice evaporates and is introduced into the air path of the device 101. For example, as the flavoring juice is absorbed by the media, a surface area of the flavoring juice exposed to air passing through the media can be increased, thus increasing a rate at which the flavoring juice evaporates.

In some embodiments, the flavoring pack can include a separate wick and heater coil. For instance, the electrical leads in the flavoring pack that connect the coil 124 in the device 101 to the battery assembly can also be connected to a coil located in the longitudinal hole that passes through the flavoring pack. In an example, the coil located in the flavoring pack can be wired in series and/or in parallel with the coil 124 in the device 101. In some embodiments, a wick can extend through an orifice located in the inner cylindrical wall of the flavoring pack and extend through the coil. The flavoring juice can be pulled from the annular tank along the wick to the coil, where vaporization can occur.

Figure 3:
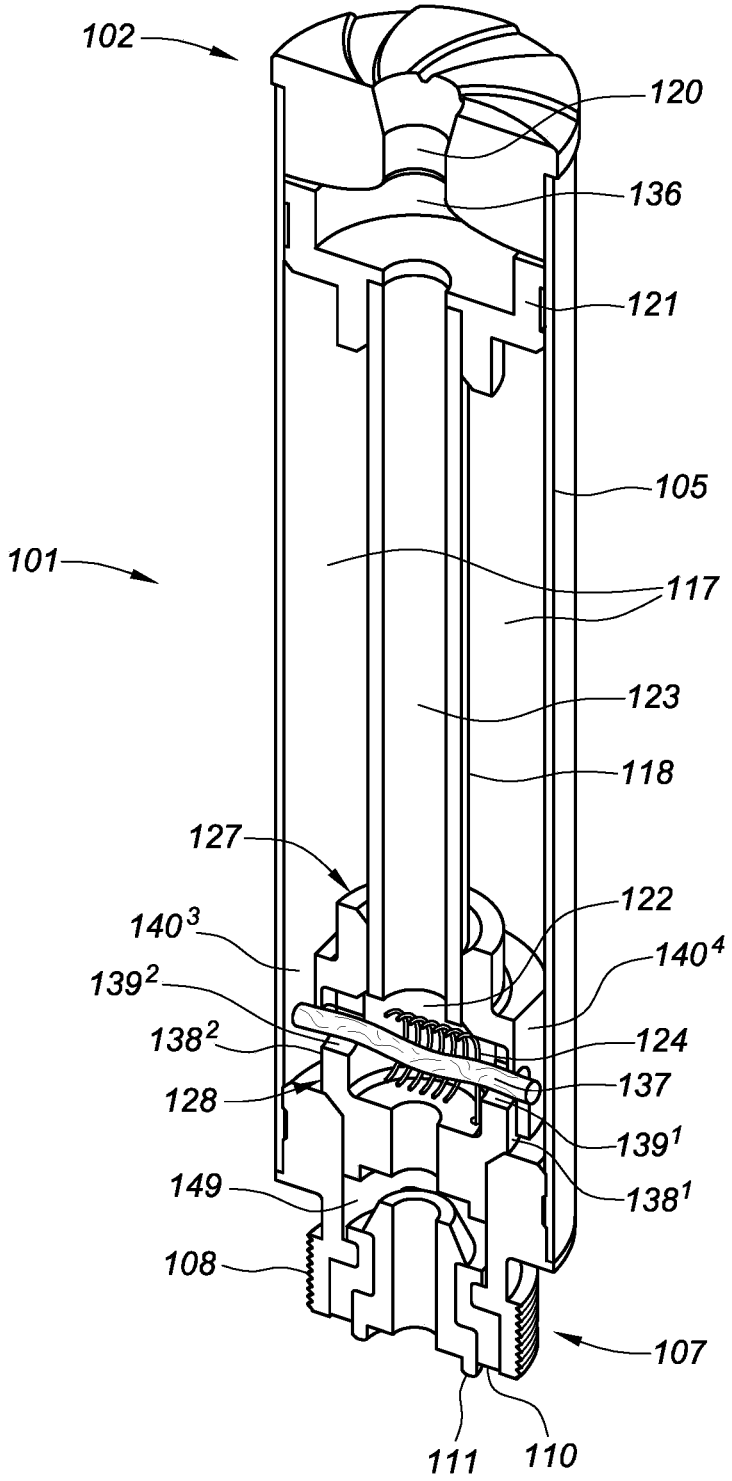
FIG. 3 depicts an isometric, cross-sectioned view of the top and side of the device depicted in FIG. 2 rotated 90 degrees about a longitudinal axis of the device from the orientation depicted in FIG. 2.

FIG. 3 is an isometric, cross-sectioned view of the top and side of the device 101 depicted in FIG. 2 rotated 90 degrees about a longitudinal axis of the device 101 from the orientation depicted in FIG. 2. The device 101 includes a mouth piece 102 inserted into a proximal end of an outer tube 105. A liquid media storage tank 117 can be included in the device 101 and can be formed by the outer tube 105 and the inner tube 118. In some embodiments, a proximal seal 121 can be placed between the inner tube 118 and the mouth piece 102, as discussed herein, and an outer surface of the proximal seal 121 can connect with an inner surface of the outer tube 105 to create a seal between the liquid media storage tank 117 and the mouth piece 102.

In some embodiments, the proximal seal 121 can include an expansion chamber 136 and the mouth piece 102 can include a passageway 120, through which vapor can flow. In an example, the expansion chamber 136 can have a larger diameter than the inner diameter of the inner tube 118, thus slowing a flow of the vapor to cause turbulence and an increased mixing and/or breaking apart of liquid droplets in the air stream. The vapor can then flow through the passageway 120, which has a smaller inner diameter than the expansion chamber 136, where the flow of the vapor can be sped up, causing additional mixing and/or breaking apart of liquid droplets in the air stream. A proximal portion of the passageway 120 can be flared (e.g., have a wider diameter), which can provide for a decreased flow velocity of the vapor as it enters the user's mouth.

In some embodiments, an inner diameter at the distal end of the inner tube 118 can be a same size as an inner diameter at the proximal end of the inner tube 118, resulting in a cylindrical inner surface. Alternatively, in some embodiments, an inner diameter at the distal end of the inner tube 118 can be larger than an inner diameter at the proximal end of the inner tube 118, thus forming a frustoconical shape. In an example, the frustoconical shape of the inner tube 118 can speed up a flow of the vapor through the inner tube 118 before the vapor exits into the expansion chamber 136, in some embodiments. The speeding up of the flow of the vapor in the inner tube can cause increased mixing and/or breaking apart of liquid droplets; and the consecutive slowing down of the flow of vapor in the expansion chamber 136 can cause additional turbulence and thus increased mixing and/or breaking apart of liquid droplets in the air stream.

In an example, such an arrangement can allow for an increased mixing and/or breaking apart of the liquid droplets in the air stream without use of in-stream mixers, while providing a desirable user experience, as opposed to prior methods. For example, some prior methods can have structures that are located in the air stream to change a direction of the flow and/or create turbulence in order to break apart liquid droplets. However, this can cause a restriction in the air path, affecting a user's experience when they draw air through the electronic cigarette. For instance, a user may encounter an increased resistance when drawing air through the electronic cigarette. This can result in a user receiving a less than desired amount of vapor, as opposed to embodiments of the present disclosure, which provide an unrestricted air path 123.

The device 101 can include the heater coil chamber 122 that is formed by the heater coil housing 127 and the heater coil support 128, which houses the heater coil 124. In some embodiments, the heater coil 124 can be disposed horizontally across the heater coil chamber 122, as illustrated in FIG. 3. Alternatively, the heater coil 124 can be disposed vertically within the heater coil chamber 122.

In some embodiments, a wick 137 can extend through a center of the heater coil 124 and through a port in a sidewall of the heater coil chamber 122 into a recessed pocket $\mathbf{140}^1$, $\mathbf{140}^2$, $\mathbf{140}^3$, $\mathbf{140}^4$, hereinafter generally referred to as recessed pocket 140, of the liquid media storage tank 117. The wick 137 can extend through a port that extends through the heater coil support 128, and in some cases can extend through the heater coil housing 127. In some examples, one side of the wick 137 can extend through the port in the sidewall of the heater coil chamber 122. Alternatively, a first side of the wick 137 can extend through a first port $\mathbf{139}^1$ in the heater coil chamber 122 into a portion of the recessed pocket $\mathbf{140}^4$ and a second side of the wick 137 can extend through a second port $\mathbf{139}^2$ in the heater coil chamber 122 located on an opposite side of the heater coil chamber from the first port 139$^1$ into a portion of the recessed pocket 140$^3$.

In some embodiments, the ports 139$^1$, 139$^2$ can be formed by the heater coil housing 127 and the heater coil support 128. In an example, upon assembly of the heater coil housing 127 and the heater coil support 128, the ports 139$^1$, 139$^2$ can be formed. For instance, with reference to FIGS. 11A-11C, the heater coil support 325 can include heater notches 363$^1$, 363$^2$. The heater coil housing 127 can include complementary notches, as illustrated in FIG. 3. In some embodiments, upon assembly of the heater coil housing 127 and the heater coil support 128, the ports 139$^1$, 139$^2$ can be formed and the wick can be held in place between the heater coil housing 127 and the heater coil support 128.

In some embodiments, the ports 139$^1$, 139$^2$ can have a smaller diameter than that of the wick 137. In an example, the wick 137 can be compressed by the smaller diameter of the ports 139$^1$, 139$^2$. Compression of the wick can prevent liquid from freely flowing between an interface of the wick and the ports 139$^1$, 139$^2$, thus preventing liquid from leaking into the heater coil chamber 122. In some embodiments, the diameter of the ports 139$^1$, 139$^2$ can be 5 to 20 percent smaller than the diameter of the wick 137. In some embodiments, the diameter of the ports 139$^1$, 139$^2$ can be 10 to 15 percent smaller than the diameter of the wick 137 (e.g., transverse to a longitudinal axis of the wick 137). In an example, in some embodiments, the diameter of the ports 139$^1$, 139$^2$ can be 10 percent smaller. For instance, the diameter of the ports 139$^1$, 139$^2$ can be 1.8 millimeters and the diameter of the wick 137 can be 2 millimeters.

In some embodiments, the recessed pocket 140$^1$, 140$^2$, 140$^3$, 140$^4$ can be formed by an outer surface of the heater coil housing 127 and the inner surface of the outer tube 105. For example, the recessed pocket 140 can be formed by an outer surface of the base portion 130 of the heater coil housing 127 and the inner surface of the outer tube 105, forming an annular recessed pocket 140 around the base portion 130 of the heater coil housing 127.

In an example, the recessed pocket 140 can be configured to retain liquid from the liquid medium storage tank 117, as a result of surface tension. For instance, liquid that enters the recessed pocket 140 can tend to want to remain in the recessed pocket 140, independent of a subsequent orientation of the device 101. Accordingly, a greater amount of liquid in the liquid medium storage tank 117 can be used by the device 101, because remaining liquid, even a small amount, can be retained in the recessed pocket 140 and wicked to the heater coil 124 by the wick 137. In addition, a consistent flow of liquid can be provided to the heater coil 124 by the wick 137 from the liquid medium storage tank 117 up until a point where all, or nearly all of the liquid is used, in contrast to use of a porous material that holds the liquid, as used in prior methods. Because the liquid is free to move about in the liquid media storage tank 117 and does not have to travel through a porous media, which can slow the transfer of the liquid to the wick 137, a consistent amount of liquid can be provided to the wick 137.

In some prior methods that employ a tank to hold the liquid, the liquid may not make consistent contact with the wick, because the liquid is free to move about the tank (e.g., per different orientations of the device 101) and thus may not be drawn consistently to the heater coil via the wick. However, in embodiments of the present disclosure, as discussed herein, the liquid is free to move about the liquid media storage tank 117, but can be retained in the recessed pocket 140, thus ensuring a constant supply of liquid to the heater coil via the wick. The recessed pocket can be sized such that enough liquid is trapped in the recessed pocket 140 to provide liquid for one or more uses (e.g., puffs) by a user. In some examples, after the user removes the device 101 from their mouth after a puff, the orientation of the device 101 can be changed and the recessed pocket 140 can be refilled with liquid from the liquid media storage tank 117, which can subsequently be wicked to the heater coil 124.

In some embodiments, the outer surface of the heater coil housing 127 proximate to the ports 139$^1$, 139$^2$, can be recessed and/or cut out to form individual recessed pockets 138$^1$, 138$^2$ for each port 139$^1$, 139$^2$. In some embodiments, a portion of the heater coil housing 127 bordering the ports 139$^1$, 139$^2$ can be recessed and/or cut out to form individual recessed pockets 138$^1$, 138$^2$. For example, as illustrated in FIG. 3, individual recessed pockets 138$^1$, 138$^2$ can be formed proximate to each port 139$^1$, 139$^2$, which are further recessed areas in the recessed pocket 140. In an example, where only one port exists, a single recessed pocket can be formed proximate to the port. In some embodiments, the wick 137 can extend through a center of the heater coil 124 through the first port 139$^1$ in the heater coil support 128 into a first individual recessed pocket 138$^1$ in the liquid media storage tank 117 and through a second port 139$^2$ in the heater coil support 128 into a second individual recessed pocket 138$^2$ in the liquid media storage tank 117.

In some embodiments, the device 101 can be assembled in a particular way so as to maximize a volume of liquid and reduce an amount of pressure that is developed in the liquid media storage tank 117. In an example, when a pressure in the liquid media storage tank 117 is increased, the increased pressure can force liquid out of the ports 139$^1$, 139$^2$, causing liquid to be wasted and also causing possible interference with electronic components as a result of the liquid migrating from the ports 139$^1$, 139$^2$ and/or wick 137. As such, it can be desirable to maintain a reduced pressure within the liquid media storage tank 117.

Accordingly, in some embodiments, when assembling the device, the proximal seal and the mouth piece can be inserted first, along with the inner tube 118 and heater coil housing 127. The device 101 can be oriented so the mouth piece 120 points downward and a distal end of the outer tube 105 points upward. In an example, the device can then be filled with liquid to a level that is below a proximal side of the ports 139$^1$ and 139$^2$. The heater coil support 128, coil 124, wick 137, and battery connector 107 can then be inserted into the distal end of the outer tube 105. Inserting the heater coil support 128, coil 124, wick 137, and battery connector 107 into the distal end of the outer tube 105 can result in a build-up of pressure in the liquid media storage tank 117. However, because the device 101 is placed in an orientation where the ports 139$^1$ and 139$^2$ remain above a level of the liquid in the liquid media storage tank 117, air can pass through the ports 139$^1$ and 139$^2$ and out of the device 101 via the axial cylindrical opening 112 and/or the passageway 120 in the mouthpiece 102.

Alternatively, if the device 101 is placed in an orientation where the battery connector 107 points downward and is subsequently filled, liquid can leak from the ports 139$^1$ and 139$^2$, as the upper seal 121 is set in place. For example, placement of the upper seal can cause an increased pressure in the liquid media storage tank 117, thus causing liquid to be expelled from the ports 139$^1$, 139$^2$.

In some embodiments, the liquid can have a viscosity in a range from 100 centipoise to 300 centipoise at 20° centigrade, although the viscosity of the liquid can be less than 100 or greater than 300 at 20° centigrade. In some embodiments, the liquid can have a viscosity in a range from 150 centipoise to 250 centipoise at 20° centigrade. Liquid with a viscosity of less than 100 centipoise can have a tendency to flow too easily, while liquid with a viscosity of greater than 300 can have a tendency to not flow easily enough. Liquids with a viscosity of less than 100 centipoise can tend to flow through the ports 139[1], 139[2] into the heater coil chamber 122 and/or can over-saturate the wick 137 with liquid, causing liquid to drip from the wick into the heater coil chamber 122. Thus, liquid with a viscosity of less than 100 centipoise can cause too much liquid to flow through the ports 139[1], 139[2]. In an example, as the liquid comes within a close proximity of the heater and/or heater coil chamber, the liquid can be heated and a viscosity of the liquid can be reduced. For instance, liquids that have a viscosity of 100 centipoise at 20° centigrade can have a lower viscosity of 25 centipoise at 50° centigrade (e.g., the temperature that the liquid can be warmed to when in close proximity to the heater and/or heater coil chamber). The lower viscosity of the heated liquid (e.g., 25 centipoise) can cause the liquid to flow too easily, resulting in over-saturation of the wick 137, causing liquid to drip from the wick into the heater coil chamber 122. In an example, liquid with a viscosity of at least 150 centipoise can provide a viscosity at 50° centigrade that will not cause over-saturation of the wick 137 and/or the liquid to drip from the wick and/or from an interface between the wick 137 and the ports 139[1], 139[2]. Liquids with a viscosity of greater than 300 centipoise may not effectively flow from the media storage tank 117 and may not be effectively wicked from the media storage tank 117 by the wick 137. Thus, liquids with a viscosity of greater than 300 centipoise may not allow enough liquid to enter through the ports 139[1], 139[2] and/or be wicked into the wick 137 for vaporization by the heater coil.

Figure 4A:
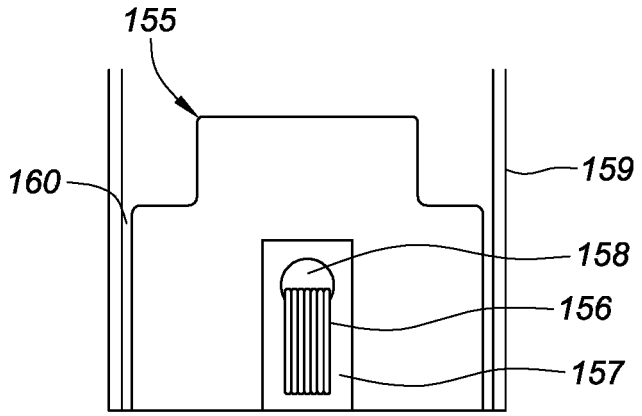
FIG. 4A depicts an embodiment of the recessed pockets in the heater coil housing depicted in FIG. 3, in accordance with embodiments of the present disclosure.

FIG. 4A depicts an embodiment of the individual recessed pockets in the heater coil housing depicted in FIG. 3, in accordance with embodiments of the present disclosure. In an example, the heater coil housing 155 can be recessed to form the individual recessed pocket 157 proximate to port 158. The wick 156 can extend out of port 158 and into the individual recessed pocket 157, where liquid can have a tendency to be held as a result of surface tension, as discussed herein. In an example, the individual recessed pocket 157 can have a greater tendency to hold the liquid than a configuration where a uniform recessed pocket is formed around the perimeter of the heater coil chamber between the heater coil housing 155 and an inner surface of the outer tube 159. Embodiments of the present disclosure can include a recessed pocket 160 around the perimeter of the heater chamber, in addition to one or more individual recessed pockets 157 proximate to each port 158, further enabling the fluid to be held such that it can be drawn from the one or more individual recessed pockets 157 to the heater coil via the wick 156.

Figure 4B:
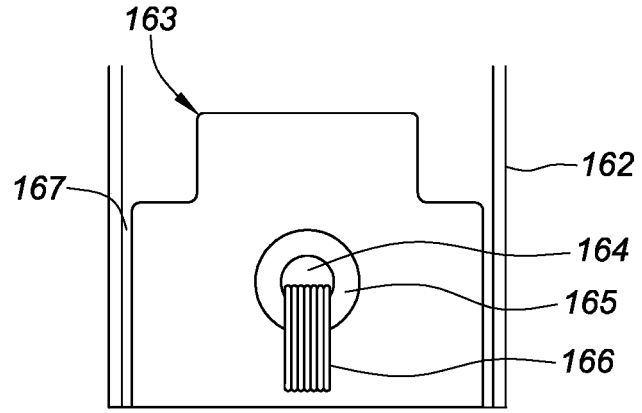
FIG. 4B depicts an alternate embodiment of the recessed pockets in the heater coil housing depicted in FIG. 3, in accordance with embodiments of the present disclosure.

FIG. 4B depicts an alternate embodiment of the recessed pockets in the heater coil housing depicted in FIG. 3, in accordance with embodiments of the present disclosure. In an example, the heater coil housing 163 can be recessed to form the individual recessed pocket 165 proximate to each port 164. In an example, the individual recessed pocket 165 can be a hole drilled through the sidewall of the heater coil housing 163 that is larger in diameter than the port 164. In some embodiments, the hole can have chamfered sidewalls, which can affect how fluid enters the individual recessed pocket 165. The wick 166 can extend into the individual recessed pocket 165 and in some embodiments can also extend into the recessed pocket 167. In an example, the individual recessed pocket 165 can provide for improved retention of liquid over various orientations of the device 101, as a result of surface tension. In addition, the recessed pocket 167 can retain an increased volume of liquid.

Alternatively, in some embodiments, a hole can exist in the heater coil housing that is the same diameter as the port existing in the heater coil support. The wick can pass through the hole in the heater coil housing and the hole in the heater coil support and can extend into the recessed pocket 167. In such an embodiment, no individual recessed pocket may exist and the wick may extend directly into the recessed pocket.

Figure 4C:
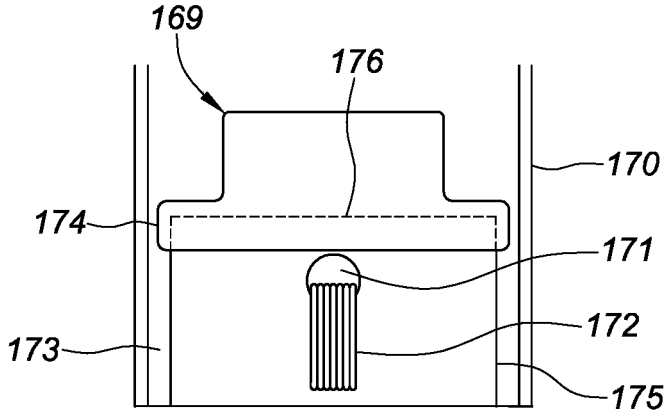
FIG. 4C depicts an alternate embodiment of the recessed pockets in the heater coil housing depicted in FIG. 3, in accordance with embodiments of the present disclosure.

FIG. 4C depicts an alternate embodiment of the recessed pockets in the heater coil housing depicted in FIG. 3, in accordance with embodiments of the present disclosure. In an example, the heater coil housing 169 can overlap the coil support wall 175 up to the port 171. For example, an inner wall of the heater coil housing 169 can overlap an outer wall of the coil support up to each port 171. The overlapped portion of the heater coil support wall 175 is illustrated by the dotted line 176, in FIG. 4C. In an example, the wick 172 can extend into a recessed pocket 173 that extends around a circumference of a base of the liquid media storage tank 117.

In some embodiments, an outer circumference of the heater coil housing 169 can form a recessed pocket lip 174, which can be configured to retain liquid in the recessed pocket 173 via surface tension. For example, liquid can enter the recessed pocket 173 and can be retained in the recessed pocket 173, as an orientation of the device 101 is changed. The recessed pocket 173 that extends around the circumference of the base of the liquid media storage tank 117, as illustrated in FIG. 4C can retain more liquid than prior methods, while still retaining the liquid via the recessed pocket lip 174. In an example, this can be beneficial when the device 101 is not regularly placed in an orientation that allows gravity to fill the recessed pocket 173 with liquid stored in the liquid media storage tank 117.

As illustrated in FIGS. 4A-4C, the ports 158, 164, 171 are illustrated as not entirely filled by the wicks 156, 166, 172, respectively. As discussed herein, in some embodiments, the diameter of the port can be less than a diameter of the wick, such that the wick is compressed within the port, which can prevent liquid from leaking into the heater coil chamber 122 from the media storage tank 117.

With reference to FIG. 2, the device 101 can include a battery connector 107 that comprises an annular outer surface that connects with the inner surface of the outer tube 105 and an annular inner surface configured to connect with an insulator grommet 110 and center battery connect 111. In some embodiments, the battery connector 107 can include a cylindrical base portion 144 and a cylindrical neck portion 145 connected to one another. In some examples, the base portion 144 of the battery connector 107 can be inserted into a distal end of the outer tube 105 a defined amount. For example, the base portion 144 of the battery connector 107 can be inserted into the distal end of the outer tube 105 up until stepped portion 109 makes contact with the outer tube 105. In some embodiments, the battery connector 107 can also be connected with the neck portion 131 of the heater coil support 128. The base portion 144 of the battery connector 107 can include an axial cylindrical opening with a diameter that is larger than the neck portion 131 of the heater coil support 128. In an example, the diameter of the neck portion 131 of the heater coil support 128 and the diameter of the axial cylindrical opening of the base portion 144 of the battery connector 107 can be such that the neck portion 131 of the heater coil support 128 can be press fit into the base portion 144 of the battery connector 107.

In some embodiments, the battery connector 107 can include a neck portion 145 and an outer surface of the neck portion 145 can include a threaded portion 108 for threading into a battery assembly. The neck portion 145 of the battery connector 107 can include an axial cylindrical opening and a retainer ring 146 disposed around a perimeter of the axial cylindrical opening. An insulator grommet 110 can be inserted into the axial cylindrical opening of the neck portion 145 of the battery connector 107.

In some embodiments, the insulator grommet 110 can be made of an insulative material that is flexible such as a plastic and/or rubber and can be connected with the battery connector 107 via a lip portion 150. In an example, the insulator grommet 110 can be inserted into the axial cylindrical opening in the neck portion 145 of the battery connector 107 and the lip portion 150 can engage the retainer ring 146. The insulator grommet 110 can include an axial cylindrical opening in which a center battery connect 111 can be inserted. The center battery connect 111 can include a lip portion 147 that can engage the insulator grommet 110 to connect the center battery connect 111 to the insulator grommet 110 and to the battery connector 107. The center battery connect 111 can include an axial cylindrical opening 112 through which air can be drawn into the chamber air inlet 126. In an example, the axial cylindrical opening 112 can be in communication with an air path located in the battery assembly connected with the battery connector 107. Air can be drawn through the battery assembly and into the axial cylindrical opening 112.

The insulator grommet 110 can provide an insulative spacer between the center battery connect 111 and the neck portion 145 of the battery connector 107 and the base portion 144 of the battery connector 107. In an example, a first terminal of the battery can electrically connect with the center battery connect 111 and a second terminal of the battery can electrically connect with the neck portion 145 and/or base portion 144 of the battery connector 107 via the threaded portion 108. Power can be provided to the heater coil 124 via a wire 152 connected with a first side of the heater coil 124 and the base portion 144 and/or neck portion 145 of the battery connector 107 and a wire 148 connected with a second side of the heater coil 124 and the center battery connect 111. In an example, as previously discussed, wires 148, 152 can also extend through passageways (not shown) in the neck portion 131 of the heater coil support 128 from the heater coil 124 to the center battery connect 111 and/or to the base portion 144 and/or neck portion 145 of the battery connector 107, thus connecting terminals of the battery to the heater coil 124.

Alternatively, the wires 148, 152 can extend through the chamber air inlet 126. In some embodiments, a wire holder 119 can be provided that can guide the wires 148, 152 from the center battery connect 111 to the heater coil 124. In an example, the wire holder 119 can hold the wires 148, 152 in a center of the passageway and/or in the chamber air inlet 126 such that the wires 148, 152 do not rub on the heater coil support 128, causing a short, for example. In some examples, the heater coil support 128 and/or the heater coil housing 127 can be electrically connected with the base portion 144 and/or the neck portion 145 of the battery connector 107. As such, a wire can extend from the heater coil 124 to the heater coil housing 127 and/or the heater coil support 128 to electrically connect the heater coil 124 to the battery, in some embodiments.

In some embodiments, the battery connector 107 can include an air inlet 113 that can be in communication with an air inlet chamber 149. As a result of a user drawing air through the mouth piece 102, air can be drawn in through the air inlet 113 and into the air inlet chamber 149. The air can be drawn through the chamber air inlet 149 and into the heater coil chamber 122. Liquid that has been wicked into the heater coil 124 via the wick 137 can be heated and vaporized and can be drawn through the air path 123 and passageway 120 into the user's mouth. In some embodiments, the air and vaporized liquid can be drawn into the expansion chamber 136, as discussed herein.

With reference to FIG. 3, the battery connector 107 is shown inserted into the distal end of the outer tube 105 and includes the threaded portion 108, the center battery connect 111, and the insulator grommet 110. In some examples, air can be drawn into the air inlet chamber 149 from an air inlet and an axial cylindrical opening 112 in the center battery connect 111, as shown in FIG. 2, and into the heater coil chamber 122, where liquid can be vaporized by the heater coil 124 and can be drawn through the inner tube 118 into the expansion chamber 136 and through the passageway 120 of the mouth piece 102.

Figure 5:
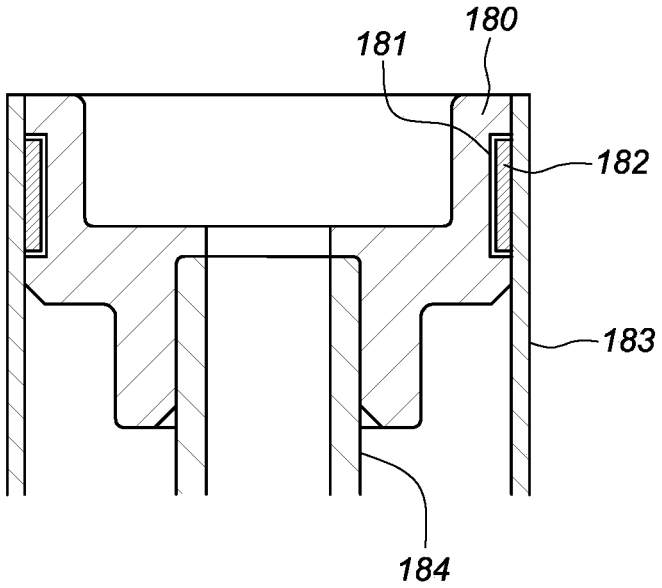
FIG. 5 depicts a connector, in accordance with embodiments of the present disclosure.

FIG. 5 depicts a connector, in accordance with embodiments of the present disclosure. The inner tube 184 is shown as inserted into proximal seal 180, and proximal seal 180 is shown as inserted into outer tube 183 and connected with outer tube 183 via a frictionally engaged connection. In an example, the outer tube 183 has a lip portion 182 and the proximal seal has a corresponding recessed portion 181. As discussed herein, the proximal seal 180 and the outer tube 183, and/or other portions of the device 101 and/or electronic cigarette (e.g., mouth piece 102 and outer tube 105, inner tube 118 and proximal seal 121, heater coil housing 127 and heater coil support, outer tube 105 and battery connector 107, etc., as shown in FIGS. 2 and 3) can be connected via a frictionally engaged connection. The frictionally engaged connection can include a lip portion 182 and a corresponding recessed portion 181 that engage one another when the proximal seal 121 has been inserted into the outer tube 105 an appropriate amount to cause the lip portion 182 and the corresponding recessed portion 181 to engage one another.

In an example, prior methods can use rubber o-rings to create a seal between various portions of an electronic cigarette. For instance, portions that form a tank of an electronic cigarette can be connected and can be sealed via a gasket, such as a rubber o-ring. However, over time, these types of seals can expand and contract, become brittle, and/or can be damaged in an assembly process. Accordingly, embodiments of the present disclosure can provide a frictionally engaged connection that can connect various portions of the device 101, create a seal to prevent liquid from leaking from the tank portion, and aid in assembly of the device 101.

In some embodiments, the various components of the device 101 can be made from a polymer (e.g., plastic), which can provide cost benefits associated with material and manufacturing costs. In an example, use of a semi-elastic polymer can be desirable for use in construction of the frictionally engaged connection, as the polymer components of the device 101 can flex from their original state when one component is being inserted into another and then snap back into their original state when the lip portion 182 is lined up with the corresponding recessed portion 181. For illustration purposes, FIG. 5 illustrates a space between the lip portion 182 and the corresponding recessed portion 181, however, it can be desirable to have little and/or no space between the lip portion 182 and the corresponding recessed portion 181 to maintain a good seal between the various components to prevent liquid from escaping. In addition, having little and/or no space between the lip portion 182 and the corresponding recessed portion 181 can create a stronger connection between various components that the frictionally engaged connection is connecting.

In some embodiments, the frictionally engaged connection can be beneficial when assembling the device 101. For instance, when inserting the proximal seal 180 into the outer tube 183 (or inserting other components into one another), the proximal seal 180 can be inserted into the outer tube 183, until the corresponding recessed portion 181 lines up with the lip portion 182. As such, one component can be inserted into another component a uniform amount between devices, since the separate components are not connected until the corresponding recessed portion 181 lines up with the lip portion 182. In some embodiments, an adhesive can be used in addition to the frictionally engaged connection. In an example, adhesive can be applied to one or both of the components and they can be inserted into one another until the corresponding recessed portion 181 engages the lip portion 182. The frictionally engaged connection can hold the components together while the adhesive cures, in some embodiments.

Figure 6:
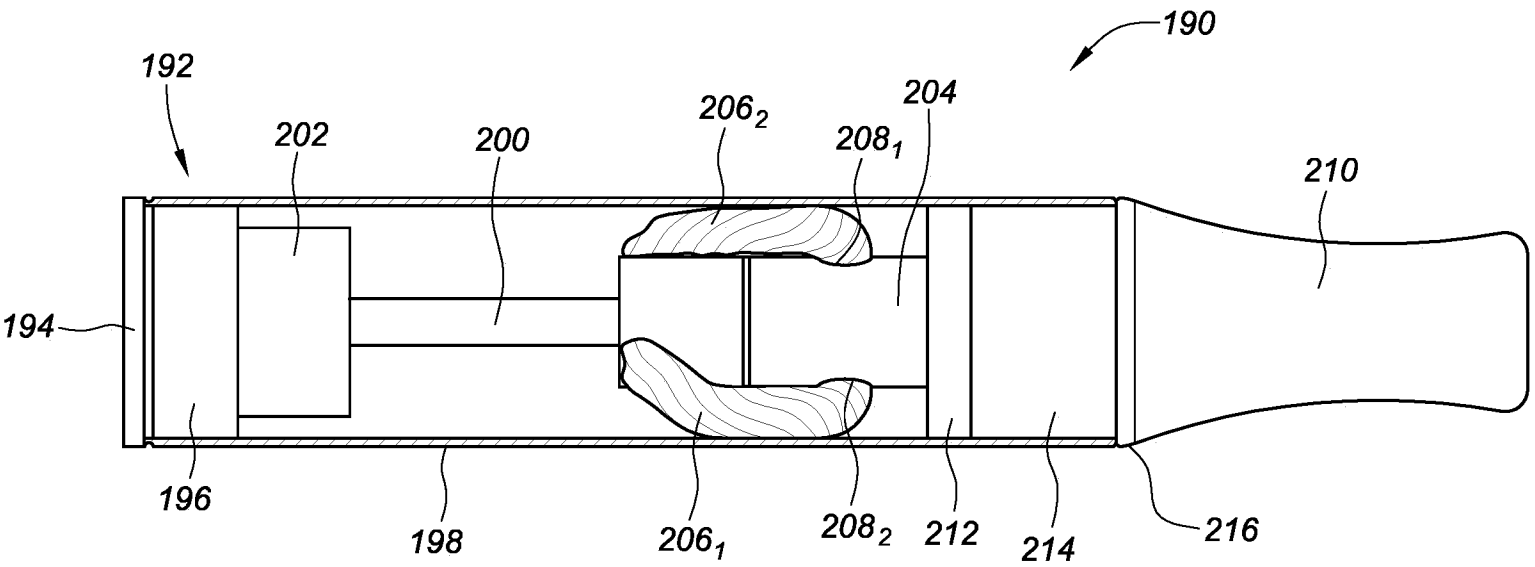
FIG. 6 depicts a side view of another embodiment of a device for storing and vaporizing liquid media, in accordance with embodiments of the present disclosure.

FIG. 6 is a side view of another embodiment of a device 190 for storing and vaporizing liquid media, in accordance with embodiments of the present disclosure. The device 190 can include a battery connector 192 that has a lip portion 194 and an outer surface 196. The lip portion 194 can have a larger diameter than the outer surface 196, such that the outer surface 196 can be inserted into an outer tube 198 up to the lip portion 194, which can prevent the battery connector 192 from being pushed too far into the outer tube 198. In some embodiments, air can be drawn into the device 190 via an air inlet chamber included in the battery connector 192 and into an inner tube 200 that is connected with the battery connector 192.

In some embodiments, the inner tube 200 can be connected with the battery connector 192 via an inner tube mount 202. The inner tube mount 202 can have an outer diameter that is less than a diameter of the outer surface 196 of the battery connector 192. Thus a space can exist between an outer diameter of the inner tube mount 202 and an inner diameter of the outer tube 198. A capacity of a fluid reservoir formed in part by the outer tube 198, the inner tube 200, and a heater coil chamber 204 can be increased by allowing for space (e.g., which can be filled with fluid) to exist between the outer diameter of the inner tube mount 202 and the inner diameter of the outer tube 198. This can provide for a longer life of the device 190 before a fluid in the fluid reservoir is depleted.

An opposite end of the inner tube 200 can be connected with the heater coil chamber 204, which houses the heater coil. In an example, the opposite end of the inner tube 200 can be connected with a chamber air inlet of the heater coil chamber 204. A wick 206.sub.1, 206.sub.2 can extend through ports 208.sub.1, 208.sub.2 located in a sidewall of the heater coil chamber 204 and into the fluid reservoir. In some embodiments, locating the heater coil chamber 204, heater coil, and wick 206.sub.1, 206.sub.2 in an end of the fluid reservoir proximate to a mouthpiece 210 can result in a higher percentage of the vaporized fluid reaching an outlet of the mouth piece 210. For example, by reducing a distance between the heater coil, where the fluid is vaporized, and the outlet of the mouth piece 210, a smaller percentage of vapor in the air and vapor mixture can be condensed within the device 190. This can result in a greater amount of vapor being inhaled by the user, improving the user's experience with the device 190.

In some examples, proximal seal 212 can be placed between the heater coil chamber 204 and the outer tube 198. In an example, the proximal seal 212 can prevent liquid from leaking from the device 190. The proximal seal 212 can be annular in shape, with an outer diameter approximately the same as an inner diameter of the outer tube 198. In an example, the outer diameter of the proximal seal 212 can be slightly larger than the inner diameter of the inner tube 200 to allow for the proximal seal 212 to compress when it is inserted into the outer tube 198. An inner diameter of the proximal seal 212 can be approximately the same as an outer diameter of the heater coil chamber 204. In an example, the inner diameter of the proximal seal 212 can be slightly smaller than the outer diameter of the heater coil chamber 204 to allow for the proximal seal 212 to compress when the heater coil chamber 204 is inserted through the proximal seal 212. Alternatively, an inner diameter of the proximal seal 212 can be sized such that the heater coil chamber 204 is not inserted through the proximal seal 212, but rather abuts the proximal seal 212.

The air and vapor mixture can be drawn from the heater coil chamber 204 and through the mouth piece 210. In some embodiments, the mouth piece 210 can include an outer surface 214 that has a diameter that is sized such that the mouth piece 210 can be inserted into the outer tube 198, up to the lip portion 216. The mouth piece 210 can be connected with the inner tube 200, as discussed herein. In some embodiments, an inner surface of the mouth piece 210 can be a frustoconical shape. As such, the air and vapor mixture can be sped up and/or slowed down as a result of the shape of an inner surface of the mouth piece 210.

Figure 7:
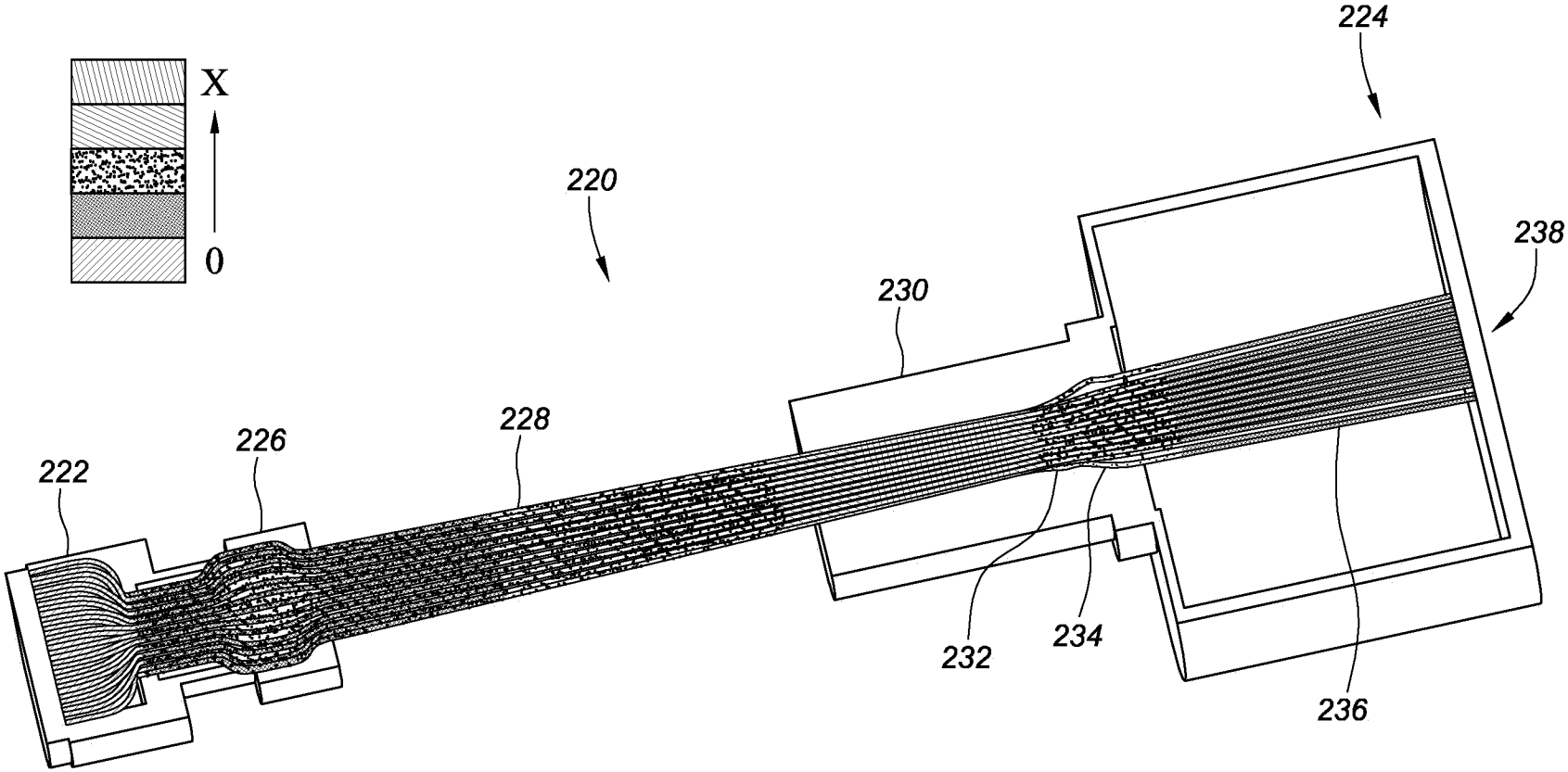
FIG. 7 depicts a cross-sectioned side view of a device for storing and vaporizing media and depicts representative flow velocities at various locations along a flow path, in accordance with embodiments of the present disclosure.

FIG. 7 is a cross-sectioned side view of a device for storing and vaporizing media and depicts representative flow velocities at various locations along a flow path, in accordance with embodiments of the present disclosure. In some embodiments, FIG. 7 can be representative of a flow diagram associated with the device illustrated in FIGS. 1A to 1C. FIG. 7 includes a legend indicating a velocity of air flow through the device 220. The velocity indicator legend is indicative of velocities ranging from 0 meters per second (m/s) to X m/s, where X can represent a maximum velocity of air flow through the device 220. In some embodiments, a maximum velocity can be in a range from 80 to 120 m/s. In some embodiments, the maximum velocity can be in a range from 90 to 110 m/s, however, the maximum velocity can be less than 80 m/s or greater than 120 m/s. In an example, the velocity indicator legend can indicate a linear progression of increased velocities between the minimum velocity (e.g., 0) and the maximum velocity (e.g., X).

In an example, a battery connector 222 can include an air inlet chamber, where air is drawn into the device 220 when a user draws air from a mouthpiece 224 of the device 220. As air is drawn into the device 220 through the air inlet chamber, the air can have a velocity in a range from 0 and 20 m/s within the air inlet chamber. The air can then be drawn through a passageway located in a heater coil chamber 226, which can house the heater coil. The air can enter the passageway located in the heater coil chamber 226, a velocity of the air can increase to a velocity in a range from 20 m/s to 50 m/s within the heater coil chamber 226.

The heater coil and wick located in the heater coil chamber 226 can cause the air passing over the heater coil and wick to become turbulent in some examples. An increase in turbulence can cause an increased mixing of the air and fluid vaporized by the heater coil. For example, a particle size of the fluid vaporized by the heater coil can be decreased as a result of the increase in turbulence of the air passing over the heater coil. A mixture of air and vapor can pass from the heater coil chamber 226 and into the inner tube 228 of the device 220. The mixture of air and vapor can travel through the inner tube 228 toward the proximal seal 230 and through the mouth piece 224.

In some embodiments, the inner tube 228 can be frusto-conical in shape and an inner diameter of the inner tube 228 can decrease toward an end of the inner tube 228 that is proximate to the proximal seal 230. The decrease in the inner diameter of the inner tube 228 towards the proximal seal 230 can cause a velocity of the air flow in the inner tube 228 to increase from an end of the inner tube 228 proximal to the heater coil chamber 226 to the end of the of the inner tube 228 proximate to the proximal seal 230. In an example, the velocity of the air flow in the inner tube 228 can be increased to a velocity in a range from 20 to 105 m/s. The air and vapor mixture can pass into the proximal seal 230 from the inner tube 228.

In an example, the proximal seal 230 can also be frusto-conical in shape, having an inner diameter that decreases from an end proximate to the inner tube 228 to an end proximate to the mouth piece 224. In some embodiments, the proximal seal 230 can include a taper area 232. The taper area 232 can be a point where an inner diameter begins to increase toward the mouth piece 224. In an example, an inner diameter of the proximal seal 230 can continually decrease from the end of the proximal seal 230 proximate to the inner tube 228 until the taper area 232. At the taper area 232, the inner diameter of the proximal seal 230 can begin to increase toward the mouth piece 224. The taper area 232 can allow for an expansion of the air and vapor mixture to occur, which can cause a velocity of the air and vapor mixture to decrease and turbulent mixing of the air and vapor mixture to occur. In an example, the velocity of the air and vapor mixture can decrease to a velocity in a range from 20 m/s to 105 m/s in the expansion area 234.

The air and vapor mixture can enter a passageway 236 of the mouth piece 224 from the expansion area 234, in some embodiments. In some examples, an inner diameter of the passageway 236 can be constant. Alternatively, an inner diameter of the mouth piece 224 can vary to cause mixing of the air and vapor mixture and/or a change in velocity of the air and vapor mixture. For example, the inner diameter of the mouth piece 224 can increase from the expansion area 234 to an outlet 238 of the mouth piece 224. As such, a velocity of the air and vapor mixture can be reduced. Alternatively, the inner diameter of the mouth piece 224 can decrease from the expansion area 234 to the outlet 238 of the mouth piece 224. As such, a velocity of the air vapor mixture can be increased from the expansion area 234 to the outlet 238 of the mouth piece 224. In some embodiments, a velocity of the air and vapor mixture can be in a range from 15 m/s and 80 m/s in the passageway of the mouth piece 224.

Figure 8A:
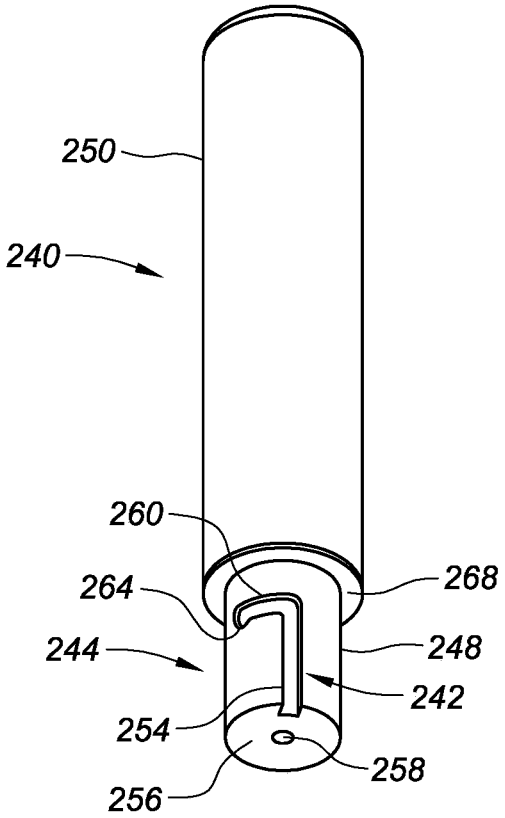
FIG. 8A depicts an isometric bottom and side view of a device for storing and vaporizing liquid media that includes a frictionally engaged connector, in accordance with embodiments of the present disclosure.
Figure 8B:
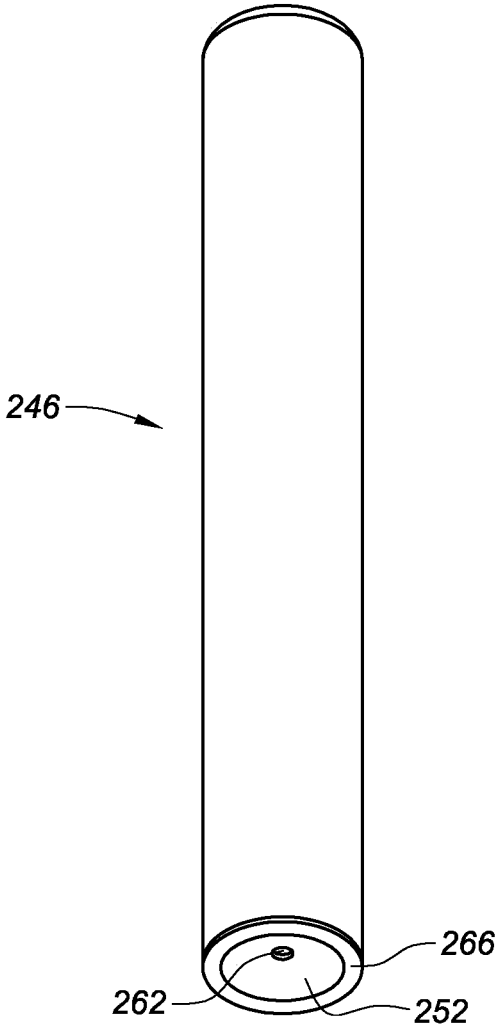
FIG. 8B depicts an isometric bottom and side view of a battery assembly that includes a frictionally engaged connector, in accordance with embodiments of the present disclosure.

FIG. 8A is an isometric bottom and side view of a device 240 for storing and vaporizing liquid media that includes a frictionally engaged connector, in accordance with embodiments of the present disclosure. Some embodiments of the present disclosure can include a frictionally engaged connection (e.g., twist lock connection). In an example, one portion of an electronic cigarette (e.g., device 240 for storing and vaporizing liquid media) can include a channel 242. The channel 242 can be formed on a battery connector 244 that extends longitudinally from a distal end of the device 240, in an example, and can be configured to connect with a battery assembly 246, as shown in FIG. 8B. In an example, the battery connector 244 can have a neck portion 248 that has an outer diameter that is less than an outer diameter of the outer tube 250 of the device 240 and can be configured to be inserted into the opening 252 of the battery assembly 246. The outer diameter of the battery connector 244 can be less than an inner diameter of the opening 252 of the battery assembly 246.

In some embodiments, the channel 242 can be formed on an outer surface of the battery connector 244 and/or in an inner wall of the opening 252. In an example, the channel 242 can have a longitudinal portion 254 that can extend proximally from a distal end of the battery connector 244 (e.g., battery connector face 256) and longitudinally along an outer surface of the neck portion 248 of the battery connector 244. In addition, the channel 242 can have a circumferential portion 260 that extends from a proximal end of the longitudinal portion 254 circumferentially along an outer surface of the neck portion 248. The walls forming the channel 242 can extend toward the axial cylindrical opening 258, such that the channel 242 is recessed below the outer surface of the neck portion 248 of the battery connector 244. In some embodiments, a surface of each wall can be parallel to one another and a surface of a base of the channel 242 can be perpendicular to a surface of each wall.

In some embodiments, the opening 252 of the battery assembly 246 can include a pin 262 that extends radially inward from an inner surface of the opening 252. In some examples, the pin can be cylindrical. The device 240 and battery assembly can be connected by lining up the pin 262 and the channel 242 with one another such that the pin 262 can slide into the longitudinal portion 254 of the channel 242. The device 240 and the battery assembly 246 can be pressed against one another such that the pin 262 travels toward a proximal end of the longitudinal channel 242. When the pin 262 reaches the proximal end of the channel 262, the device 240 can be twisted with respect to the battery assembly, such that the pin 262 travels into the circumferential channel 260.

In an example, the circumferential portion 260 can extend circumferentially and parallel with the battery connector face 256. The circumferential portion of the channel 260 can include a lock portion 264. In an example, a depth of the lock portion 264 can be a same depth as the circumferential channel 260 and longitudinal channel 254. In some embodiments, the lock portion 264 can be configured to accept the pin 262. For example, a distal wall of the lock portion 264 can extend distally toward the battery connector face and can be complimentary in shape to the pin 262. For example, where the pin 262 is a cylinder, the lock portion 264 can have a curved distal wall that accepts the pin 262.

In some embodiments, when the pin 262 is inserted in the circumferential channel 260, a proximal face 266 of the battery assembly 246 can come into contact with a stepped face 268 of the battery connector 244. In some embodiments, it can be beneficial to have the stepped face 268 and the proximal face 266 of the battery assembly 246 in tight engagement with one another when the pin 262 has been inserted into the lock portion 264. As such, the battery assembly 246 and the device 240 can remain in fixed relation to one another, such that the battery assembly 246 does not move and/or moves minimally with respect to the device 240. This can provide a solid feel to a user when handling the electronic cigarette, thus creating a positive user experience.

To provide a tight engagement between the stepped face 268 and the proximal face 266 of the battery assembly 246, the pin 262 can remain in contact with the curved distal wall of the lock portion 264 that accepts the pin 262. However, because the lock portion 264 can extend distally toward the battery connector face 256, insufficient clearance may exist between a distal wall of the circumferential portion and the pin 262 for the pin 262 to pass along the distal wall of the circumferential channel 260 when the device 240 is rotated with respect to the battery assembly 246. Accordingly, in some embodiments, an annular spacer can be inserted between the stepped face 268 of the battery connector 244 and the proximal face 266 of the battery assembly 246. In some embodiments, the spacer can be deformable, so that as the pin 262 is rotated through the circumferential portion 260, the annular spacer is compressed as it is deformed. As the pin enters the lock portion 264, the annular spacer can be expanded to provide a positive engagement between the pin 262 and the distal wall of the lock portion 264.

In some embodiments, the battery connector 244 can have more than one channel 242 and the battery assembly 246 can have more than one pin 262. For example, the battery connector 244 can have two channels diametrically opposed from one another and the battery assembly 246 can have two pins diametrically opposed from one another. Alternatively, the battery connector 244 and the battery assembly 246 can have more than two channels and pins.

Figure 9A:
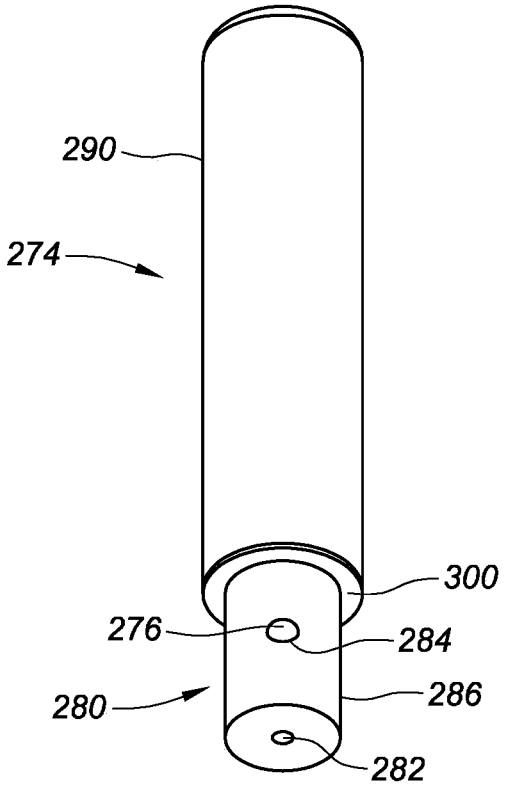
FIG. 9A depicts an isometric bottom and side view of a device for storing and vaporizing liquid media that includes an alternate embodiment of a frictionally engaged connector, in accordance with embodiments of the present disclosure.

FIG. 9A is an isometric bottom and side view of a device 274 for storing and vaporizing liquid media that includes a frictionally engaged connector, in accordance with embodiments of the present disclosure. In some embodiments, the frictionally engaged connector can include a retractable retainer 276 (e.g., ball bearing) and detent 278. In an example, one portion of an electronic cigarette (e.g., device 274 for storing and vaporizing liquid media) can include a retractable retainer 276. In some examples, the retractable retainer 276 can be a spring loaded ball bearing, as shown in FIG. 9C.

Figure 9B:
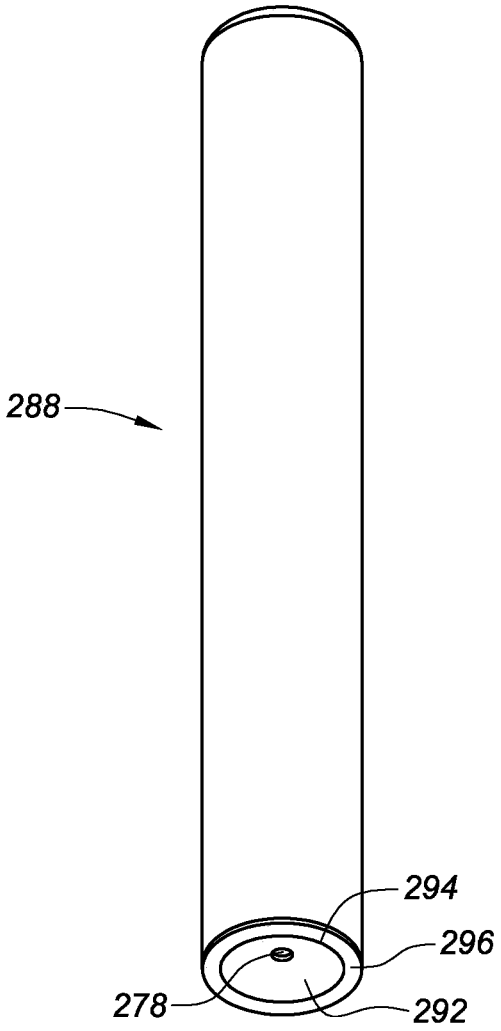
FIG. 9B depicts an isometric bottom and side view of a battery assembly that includes an alternate embodiment of a frictionally engaged connector, in accordance with embodiments of the present disclosure.
Figure 9C:
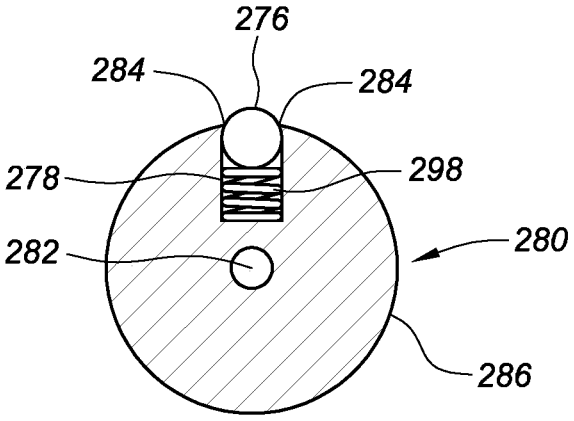
FIG. 9C depicts a cross-sectioned end view from a distal end of the device for storing and vaporizing liquid media of the alternate embodiment of the frictionally engaged connector depicted in FIG. 9A, in accordance with embodiments of the present disclosure.

FIG. 9C is a cross-sectional end view from a distal end of the device for storing and vaporizing liquid media 274 of the alternate embodiment of the frictionally engaged connector depicted in FIG. 9A, in accordance with embodiments of the present disclosure. In some embodiments, a cylindrical hole 278 can be formed in an outer surface of the battery connector 280. The cylindrical hole 278 can extend through the outer surface of the battery connector 280 toward the axial cylindrical opening 282 and can have an inner diameter that is larger than an outer diameter of the retractable retainer 276. The cylindrical hole 278 can have a circumferential lip 284 that is formed around an opening of the hole 278 and in an outer surface of the neck portion 286. The circumferential lip 284 can retain the retractable retainer 276 within the cylindrical hole 278. A spring 298 can be placed in a hole 278 between the retractable retainer 276 and a base of the hole and can be compressed such that the spring 298 pushes the retractable retainer 276 against the annular lip 284. The battery connector 280 can be configured to connect with a battery assembly 288, as shown in FIG. 9B.

FIG. 9B is an isometric bottom and side view of a battery assembly 288 that includes an alternate embodiment of a frictionally engaged connector, in accordance with embodiments of the present disclosure. In an example, the battery connector 280 can have a neck portion 286 that has an outer diameter that is less than an outer diameter of the outer tube 290 of the device 274 and can be configured to be inserted into the opening 292 of the battery assembly 288. The outer diameter of the battery connector 280 can be less than an inner diameter of the opening 292 of the battery assembly 288.

In some embodiments, the opening 292 of the battery assembly 246 can include a detent 278 that is formed in an inner surface of the opening 292. The detent 278 can be a recessed portion that is configured to accept the retractable retainer 276. In an example, the battery connector 280 can be inserted into the opening 292. As the retractable retainer 276 contacts a lip 294 formed around an inner perimeter of the proximal face 296, the retractable retainer 276 can be pressed into the hole 278. As the battery connector 280 is further inserted into the hole 292, the retractable retainer 276 can be aligned with the detent 278 and can be extended via the spring 298. A spring 298 can be selected that provides enough compression against the retractable retainer such that the battery assembly 288 remains connected with the device 274 until removed by a user.

In some embodiments, the retractable retainer 276 and the detent 278 can be aligned such that the stepped face 300 of the battery connector 280 contacts the proximal face 296 of the battery assembly 288. In addition, some embodiments can include a tongue portion on an outer surface of the battery connector 280 or an inner surface of the opening 292 and a complimentary groove portion on a mating surface. Thus, the retractable retainer 276 can be aligned with the detent by lining up the tongue and groove portions. In an example, the tongue and/or groove portions can extend longitudinally along an outer surface of the neck portion 286 of the battery connector 280 and/or longitudinally along an inner surface of the opening 292. Alternatively, in some embodiments, the neck portion 286 of the battery connector 280 and the opening 292 of the battery assembly can be shaped such that the neck portion 286 can only be inserted into the opening 292 a particular way. For instance, instead of the neck portion 286 and the opening being cylindrical, they can be formed in an oblong shape, etc.

Figure 10:
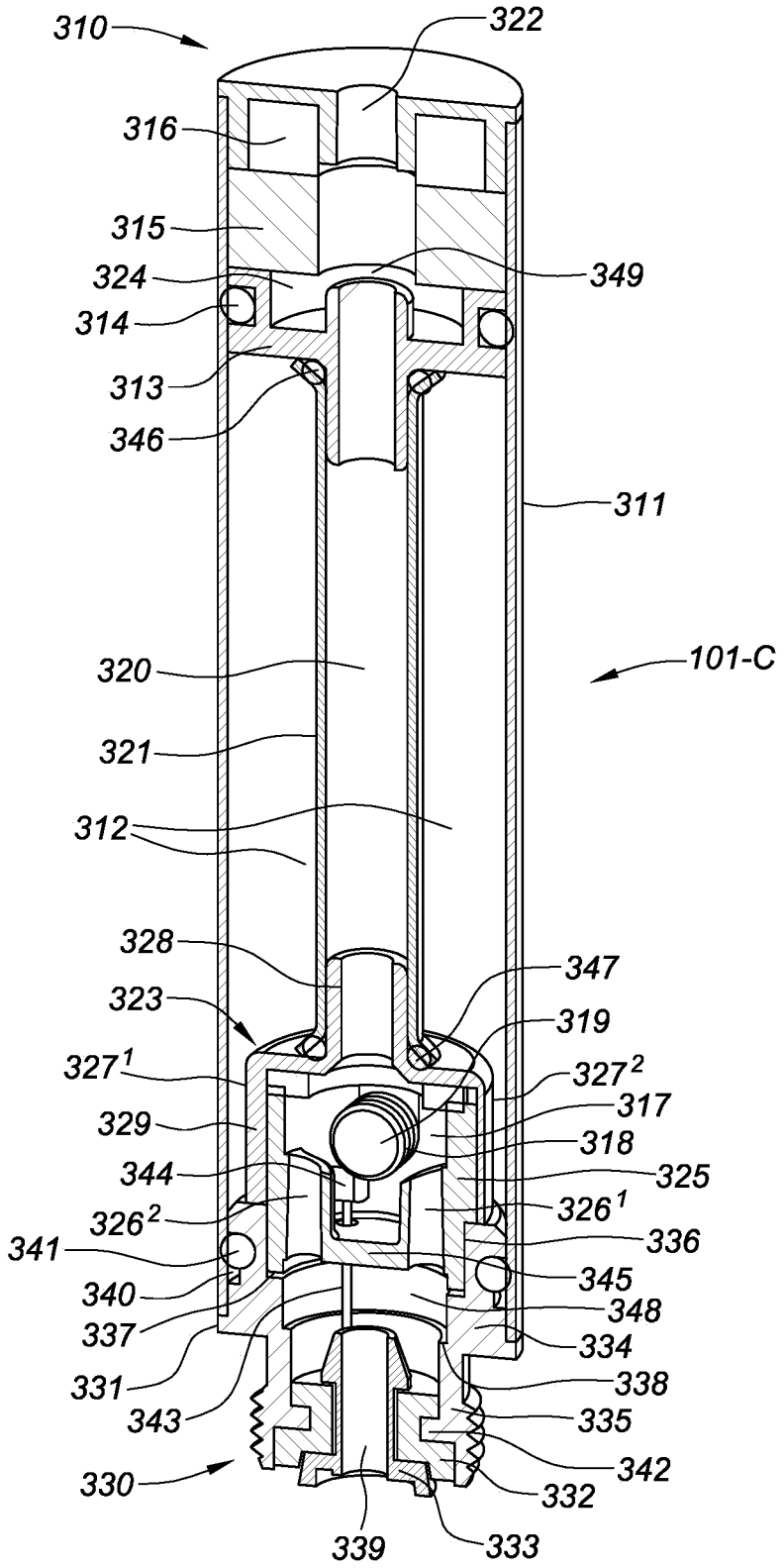
FIG. 10 depicts a cross-sectioned view of the top and side of the device depicted in FIGS. 1A-1C, in accordance with an alternate embodiment of the present disclosure.

FIG. 10 is a cross-sectioned view of the top and side of an alternate embodiment of the device 101-A depicted in FIGS. 1A-1C, in accordance with embodiments of the present disclosure. The device 101-C includes a mouth piece 310 inserted into a proximal end of an outer tube 311. The device 101-C can comprise a liquid media storage tank 312, which can be formed by the outer tube 311 and an inner tube 321, creating an annular space between the outer tube 311 and the inner tube 321. In some embodiments, a proximal seal 313 can be placed between the inner tube 321 and the mouth piece 310 and a perimeter of the proximal seal 313 can connect with an inner surface of the outer tube 311 to create a seal between the liquid media storage tank 312 and the mouth piece 310. The proximal seal 313 is more fully described herein. In an example, the proximal seal 313 can comprise a proximal seal tube, which can be an axially extending cylindrical tube, and a flange extending radially from the axially extending cylindrical tube. A perimeter of the radially extending flange can be in contact with an inner wall of the outer tube 311. In some embodiments, the radially extending flange can extend radially from the cylindrical tube between a first and second end of the cylindrical tube. In some examples, a seal portion can extend axially from an outer edge of the radially extending flange and can include an annular groove around a perimeter of the seal portion in which a seal can be placed. For example, a rubber o-ring 314 can be placed in the annular groove. In some examples, the axially extending seal portion can extend towards the mouth piece 310, leaving an annular space between the mouth piece and the radially extending flange, as further discussed herein.

In addition, a proximal end of the inner tube 321 can connect to a distal side of the proximal seal 313. For instance, a distal end of the cylindrical tube of the proximal seal 313 can be inserted into a proximal end of the inner tube 321. In an example, the cylindrical tube of the proximal seal 313 can be inserted into the proximal end of the inner tube 321, such that the proximal end of the inner tube 321 contacts the radially extending flange. In some embodiments, a distal end of the inner tube 321 can be radially flared. For example, the distal end can be flared at approximately a 45 degree angle. An annular seal 346 can be placed around the cylindrical tube of the proximal seal 313 and the inner tube 321 can be disposed over the cylindrical tube of the proximal seal 313, such that the flared distal end of the inner tube 321 contacts the annular seal 346 and compresses it between the flared portion of the inner tube 321, the radially extending flange, and the cylindrical tube of the proximal seal.

In some embodiments, absorbent material can be placed between the proximal seal 313 and the mouth piece 310. For example, a first porous material 315 can be placed between the proximal seal 313 and the mouth piece 310 and a second porous material 316 can be placed in an annular groove formed in the mouth piece, as discussed further herein. As liquid is vaporized in the heater coil chamber 317 via a heater coil 318 and wick 319, occasionally, droplets of heated liquid can be pulled off of the heater coil 318 and wick 319 and/or vaporized liquid can coalesce and/or condense within air path 320 and can collect on inner walls of inner tube 321, for example. With each puff taken by a user, liquid droplets can move proximally toward the passageway 322 of the mouth piece 310. In an example, some embodiments of the present disclosure can prevent the condensate within air path 320 from reaching the passageway 322 of the mouth piece and/or entering the user's mouth, which can provide an unfavorable experience to the user. In an example, as the condensate moves proximally toward the mouth piece 310, the condensate can contact the first porous material 315 and/or the second porous material 316 and can be absorbed by the porous materials.

In some embodiments, the proximal seal 313 can include an expansion chamber 324. In an example, the expansion chamber 324 can have a larger diameter than the inner diameter of the inner tube 321, thus slowing a flow of the vapor to cause turbulence and an increased mixing and/or breaking apart of liquid droplets in the air stream. The vapor can then flow through the passageway 322, which has a smaller inner diameter than the expansion chamber 324, where the flow of the vapor can be sped up, causing additional mixing and/or breaking apart of liquid droplets in the air stream. In addition, as discussed herein, the expansion chamber 324 can cause any condensed droplets to contact the absorbent material. For instance, as the condensed droplets travel up the air path 320, a gap 349 can exist between an inner wall of the air path 320 and the absorbent material. As such, condensed droplets can travel up the air path until they reach the gap 349, which condensed droplets may not bridge. The condensed droplets can then be pulled into the expansion chamber 324 and/or absorbed into the absorbent material.

In some embodiments, an inner diameter at the distal end of the inner tube 321 can be a same size as an inner diameter at the proximal end of the inner tube 321, resulting in a cylindrical inner surface. Alternatively, in some embodiments, an inner diameter at the distal end of the inner tube 321 can be larger than an inner diameter at the proximal end of the inner tube 321, thus forming a frustoconical shape. In an example, the frustoconical shape of the inner tube 321 can speed up a flow of the vapor through the inner tube 321 before the vapor exits into the expansion chamber 313, in some embodiments. The consecutive speeding up of the flow of the vapor in the inner tube 321 and slowing down of the flow of vapor in the expansion chamber 324 can cause turbulence and thus increased mixing and/or breaking apart of liquid droplets in the air stream. As discussed herein, such an arrangement can allow for an increased mixing and/or breaking apart of the liquid droplets in the air stream without use of in-stream mixers, while providing a desirable user experience, as opposed to prior methods.

The device 101-C can include the heater coil chamber 317 that is formed by the heater coil housing 323 and the heater coil support 325, which houses the heater coil 318. In some embodiments, the heater coil 318 can be disposed horizontally across the heater coil chamber 317, as illustrated in FIG. 10. Alternatively, the heater coil 318 can be disposed vertically within the heater coil chamber 317. In some embodiments, the wick 319 can extend through a port that extends through the heater coil housing 323 and the heater coil support 325. As discussed herein, the wick 319 can extend into a recessed pocket 327$^1$, 327$^2$ that exists between an exterior of a base portion 329 of the heater coil housing 323 and an interior of the outer tube 311. In some embodiments, the heater coil housing 323 can be annular in shape and can include a neck portion 328 and the base portion 329. The neck portion 328 can have an inner diameter that is less than an inner diameter of the base portion 329 and an outer diameter that is less than an outer diameter of the base portion 329. In an example, the neck portion 328 can be an axially extending cylindrical tube with an outer diameter that is less than an inner diameter of a distal end of the inner tube 321. The neck portion 328 can form a chamber air outlet that connects the air path 320 to the heater coil chamber 317.

In some embodiments, the neck portion 328 can be inserted into a distal end of the inner tube 321. In some embodiments, a distal end of the inner tube 321 can be radially flared. For example, the distal end can be flared at approximately a 45° angle. An annular seal 347 can be placed around the neck portion 328 of the heater coil housing 323 and the inner tube 321 can be disposed over the neck portion 328 of the heater coil housing 323. In an example, the flared distal end of the inner tube 321 can contact the annular seal 347 and compress it between the flared portion of the inner tube 321, the neck portion 328 of the heater coil housing 323, and a radially extending flange that connects the base portion 329 and the neck portion 328.

The heater coil support 325 can be cylindrical in shape and can have an outer diameter that is less than an inner diameter of the heater coil housing 323. In some embodiments, an outer diameter of the heater coil support 325 can be less than an inner diameter of the base portion 329 of the heater coil housing 323. The heater coil support 325 can be inserted into the base portion 329 of the heater coil housing 323, such that the heater coil support 325 and the heater coil housing 323 are coaxial with one another. The heater coil support 325 can include chamber air inlets 326$^1$, 326$^2$ that allow for air to be drawn into the heater coil chamber 317, and is described more in relation to FIGS. 11A-11C.

The device 101-C can include a battery connector 330 that comprises an axial cylindrical base portion 334 and an axial cylindrical neck portion 335 that are connected with one another. In some embodiments, the battery connector 330 can include a frictionally engaged connector and/or a threaded portion to engage with a battery assembly. An outer surface of the base portion 334 can connect with the inner surface of the outer tube 311. An inner surface of the base portion 334 can include an annular groove 336 configured to accept the heater coil support 325. In an example, an inner diameter of the annular groove 336 can be greater than an outer diameter of the heater coil support 325, such that the heater coil support 325 can be connected with the battery connector 330 via the annular groove 336. In an example, the heater coil support 325 can be inserted into the annular groove 336 up until a first annular step portion 337 formed in the interior wall of the battery connector 330.

In some embodiments, the battery connector 330 can include a second annular step portion 338 located distally from the first annular step portion 337. In an example, an absorbent material can be placed between the heater coil support 325 and the second annular step portion 338. The absorbent material can be formed as a cylinder, in some embodiments, and can be held in place by the heater coil support and the second annular step 338. In some embodiments, as discussed herein, liquid that has been vaporized by the heater coil 318 can condense and/or liquid that has not been vaporized can leak from the liquid media storage tank 312 and/or wick 319. As such, liquid can flow down the chamber air inlets 326$^1$, 326$^2$ into the air inlet chamber and/or axial cylindrical air inlet opening 339 causing interference with electronic components and/or causing a short circuit to occur. To prevent such an occurrence, the absorbent material can be placed between the heater coil support 325 and the second annular step portion 338 to absorb any condensed and/or leaked liquid.

In some embodiments, the base portion 334 can include an annular groove 340 extending around a perimeter of the base portion 334. The annular groove 340 can be configured to accept an annular seal 341, such as a rubber o-ring. Upon insertion of the battery connector into the outer tube 311, the o-ring can contact an inner wall of the outer tube 311 and the base portion 334 of the battery connector 330 forming a seal to prevent liquid leaking from the liquid media storage tank 312.

In some embodiments, the neck portion 335 can include a retainer ring 342 disposed around a perimeter of an axial cylindrical opening in the neck portion 335. As discussed herein, for example, in relation to FIG. 2, an insulator grommet 332 and a center battery connect 333 can be inserted into an axial cylindrical opening of the neck portion 335 of the battery connector 330.

The center battery connect 333 can be connected to a first side of the coil 318 via a wire 343 that passes through a base plate portion 345 of the heater coil support 325. In some embodiments, the wire 343 can be soldered to the center battery connect 333 and connected to the heater coil 318 via connector 344 (e.g., crimp connector). For example, the wire 343 can be stripped proximate to a connection point with the heater coil 318 and the wire can be crimped to the heater coil 318.

In some embodiments, the wire 343 can be connected to the center battery connect 333 via a solderless connection. For example, the wire 343 can be placed adjacent to the center battery connect 333. In some embodiments, the wire 343 can be parallel with an axis of the center battery connect 333, but non coaxial with the axis of the center battery connect 333. The wire 343 can be disposed between an exterior surface of the center battery connect 333 and the insulator grommet 332. For example, the insulator grommet 332 can be formed from a compliant material such as rubber, which can conform around the center battery connect 333 and can exert a force against the wire 343, such that the wire 343 maintains contact with the center battery connect 333. In some embodiments, a notch can extend along an exterior surface of the center battery connect 333. The notch can extend parallel to a central longitudinal axis of the center battery connect 333 and can be configured to accept the wire 343. In an example, the wire 343 can be pressed into the notch formed in the exterior surface of the center battery connect 333 by the insulator grommet 332.

In some embodiments, a second wire (e.g., of a reverse polarity in relation to the wire 343) can be connected to the battery connector 330. The second wire can be connected to the battery connector 330 via a solderless connection. In an example, the second wire can be disposed between an interior surface of the battery connector 330 and the insulator grommet 332. For instance, the insulator grommet 332 can exert a force against the second wire, such that the second wire maintains contact with the battery connector 330. In some embodiments, a notch can extend along an interior surface of the battery connector 330, for example, along the retainer ring 342. The notch can extend parallel to a central longitudinal axis of the battery connector 330 and can be configured to accept the second wire. In an example, the second wire can be pressed into the notch formed in the interior surface of the battery connector 330 by the insulator grommet 332.

In some embodiments, the inner tube 321 can be permanently supported at the proximal end of the inner tube 321 and the distal end of the inner tube 321. In addition, the outer tube 311 can be permanently supported at the proximal end of the outer tube 311 and the distal end of the outer tube 311. In an example, the permanently supported proximal and distal ends of the inner tube 321 and outer tube 311 can create a non-refillable media storage tank 312. For example, a proximal end of the media storage tank 312 and a distal end of the media storage tank 312 can be permanently sealed, such that the media storage tank 312 is non-refillable.

Figure 11A:
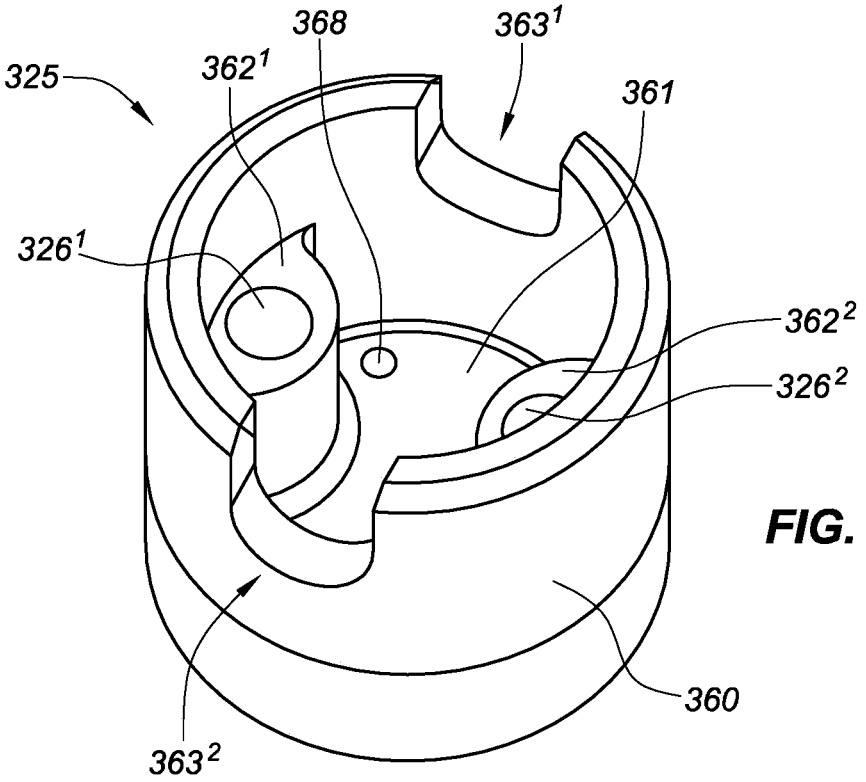
FIG. 11A depicts an isometric top and side view of a heater coil support depicted in FIG. 10, in accordance with embodiments of the present disclosure.
Figure 11B:
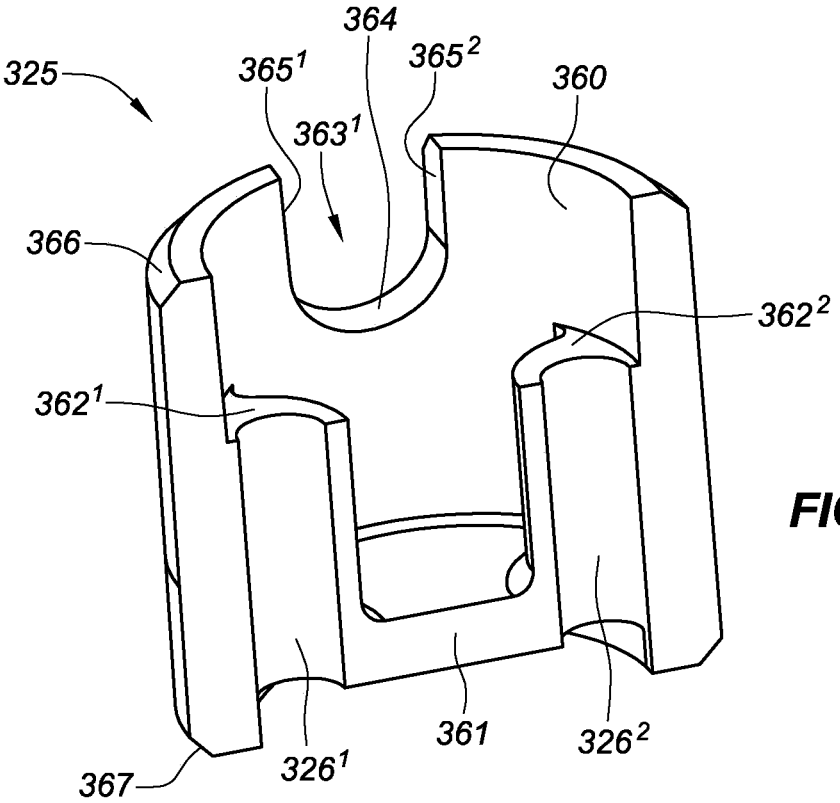
FIG. 11B depicts a cross-sectioned top and side view of the heater coil support depicted in FIG. 11A, in accordance with embodiments of the present disclosure.

FIG. 11A is an isometric top and side view of the heater coil support 325 depicted in FIG. 10, in accordance with embodiments of the present disclosure. The heater coil support 325 can comprise an axially extending support 360 with a base plate portion 361. In an example, the axially extending support 360 can be an axially extending cylinder. The heater coil support 325 can comprise a base plate portion 361 that is connected to the axially extending support 360 at a distal portion of the axially extending support 360. In an example, the base plate portion 361 can be a circular disc and a plane of the base plate portion 361 can be transverse to the longitudinal axis of the heater coil support 325 (e.g., and to the longitudinal axis of the axially extending support 360).

In some embodiments, the base plate portion 361 can include a first air inlet tube 362$^1$ that forms a first chamber air inlet 326$^1$ and a second air inlet tube 362$^2$ that forms a second chamber air inlet 326$^2$. Each of the air inlet tubes 362$^1$, 362$^2$ can extend proximally through the base plate portion 361 and can be connected with the base plate portion 361. In some embodiments, the air inlet tubes can be connected with the axially extending support 360. The air inlet tubes 362$^1$, 362$^2$ can be diametrically opposed from one another.

The axially extending support 360 can include a first heater notch 363$^1$ and a second heater notch 363$^2$ formed on a proximal lip of the axially extending support 360 and transversely opposed to the air inlet tubes 362$^1$, 362$^2$. In some embodiments, the heater notches 363$^1$, 363$^2$ can extend toward a distal end of the axially extending support 360. For example, with reference to FIG. 11B, the heater notch 363$^1$ can include a first wall 365$^1$ and a second wall 365$^2$ that extend distally along the axially extending support 360 toward a semicircular base portion 364. In an example, the semicircular base portion can be configured to hold the wick 319.

In some embodiments, an outer proximal rim 366 and an outer distal rim 367 of the axially extending support 360 can be chamfered. In an example, chamfering the outer proximal rim 366 and the outer distal rim 367 of the axially extending support 360 can allow for the heater coil support 325 to be more easily inserted into the heater coil housing 323 and into the battery connector 330. For example, where a small difference in diameter exists between an inner diameter of the base portion 329 and an outer diameter of the heater coil support 325 and/or between an inner diameter of the annular groove 336 and the outer diameter of the heater coil support 325, chamfering the outer proximal rim 366 and outer distal rim 367 can prevent binding between the heater coil support 325 and the heater coil housing 323 and/or battery connector 330.

The base plate portion 361 can include a hole 368 through which the wire 343 can pass. In some embodiments, the hole 368 can be sized such that a diameter of the hole 368 is larger than a diameter of the wire 343 passing through the hole 368. Alternatively, the hole 368 can be sized such that the diameter is substantially the same as the wire 323 passing through the hole 368. In an example, upon passing the wire 343 through the hole 368, an adhesive can be placed around a perimeter of the hole 368 to secure the wire 323 and/or create a liquid tight seal.

Figure 11C:
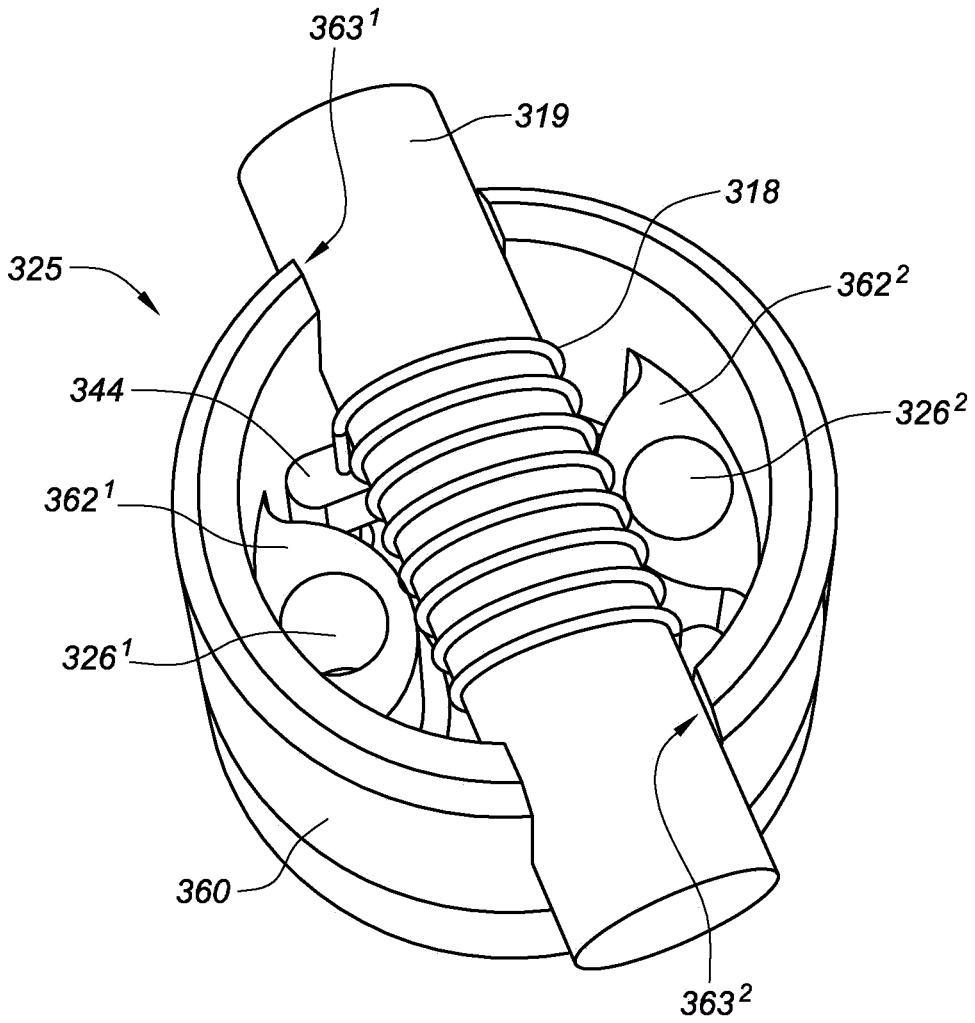
FIG. 11C depicts a top view of a heater coil support, in accordance with embodiments of the present disclosure.

In some embodiments, connecting the base plate portion 361 to the distal portion of the axially extending support 360 can create a reservoir with a depth that extends from the base plate portion 361 to a proximal end of the air inlet tubes $362^1$, $362^2$. The reservoir can allow for a build-up of liquid to occur in the reservoir without allowing the liquid to escape and cause interference with electronic components in other portions of the device 101-C and/or short circuits to occur. As shown in FIG. 11C, the wick 319 is disposed horizontally across the heater coil support 325, through the heater coil 318, and between the air inlet tubes $362^1$, $362^2$. As discussed herein, liquid that has been vaporized by the heater coil 318 can condense and/or liquid that has not been vaporized can leak from the liquid media storage tank 312 and/or wick 319. As such, in some examples, the liquid reservoir formed by the heater coil support 325 can collect the condensate and/or leaked liquid and prevent it from migrating to other portions of the device 101-C. Thus, the liquid reservoir can prevent the liquid from interfering with electrical components and/or causing short circuits. As discussed herein, creation of a liquid tight seal around the perimeter of the hole 368 can maintain a liquid tightness of the reservoir.

In some embodiments, the wick 319 and heater coil 318 can be horizontally disposed between the chamber air inlet tubes $362^1$, $362^2$ and chamber air inlets $326^1$, $326^2$. For example, the wick 319 and heater coil 318 can be disposed in heater notches $363^1$, $363^2$, which can be transversely opposed to the chamber air inlet tubes $362^1$, $362^2$. When a user draws on the device 101-C, air can pass through the chamber air inlets $326^1$, $326^2$ on either side of the wick 319 and heater coil 318. As such, air can be drawn through the axial cylindrical air inlet opening 339, into air inlet chamber 348, and through the chamber air inlets $326^1$, $326^2$. In some examples, the air flow exiting the chamber air inlets $326^1$, $326^2$ can bypass the heater coil 318 and the wick 319, such that the air flow is directed on either side of the heater coil 318 and the wick 319. This can prevent cooling of the heater coil 318 and/or wick 319, allowing for a more consistent temperature to be maintained by the heater coil 318 and thus providing for a more consistent amount of vapor delivered to the user.

Figure 12:
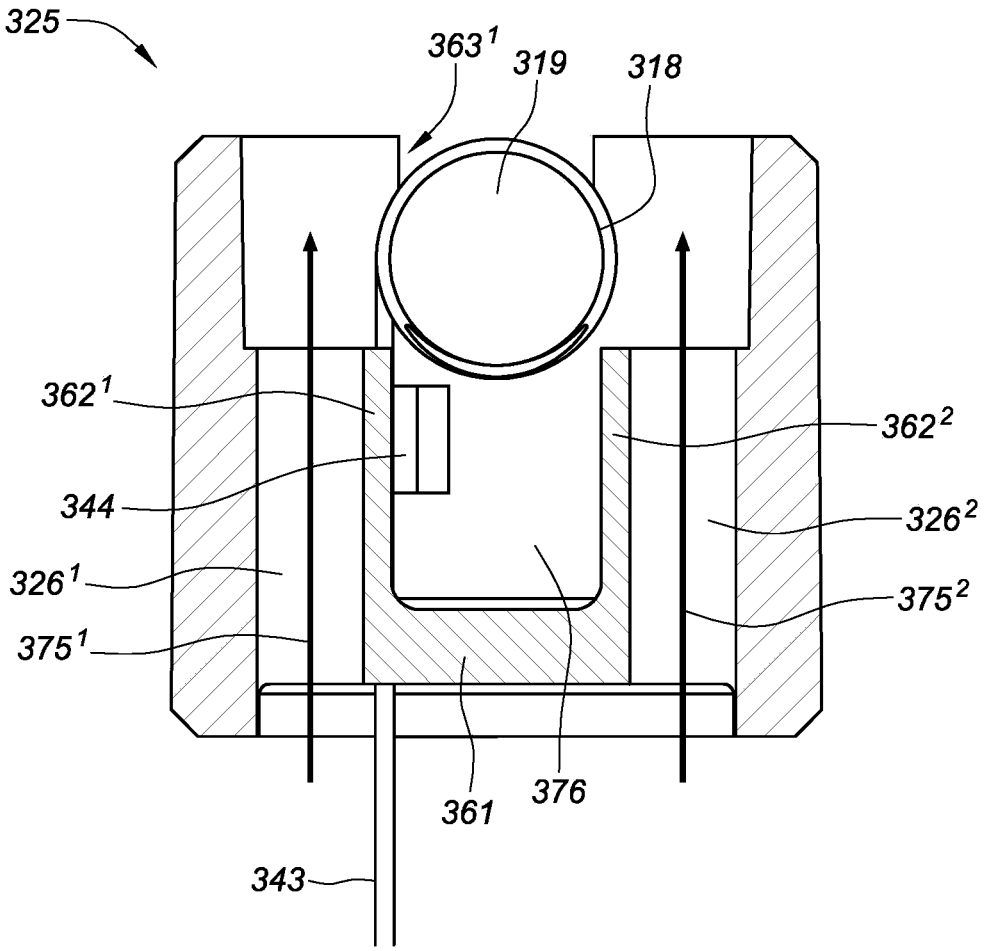
FIG. 12 depicts a side view of the heater coil support in FIG. 10, in accordance with embodiments of the present disclosure.

FIG. 12 is a side view of the heater coil support 325 in FIG. 10, in accordance with embodiments of the present disclosure. The heater coil 318 and the wick 319 are disposed horizontally across the heater coil support 325 and the wick 319 is disposed within the heater notch $363^1$. The wire 343 extends through the base plate portion 361 and is connected with the heater coil 318 via the connector 344. A first air flow $375^1$ is shown passing through a first chamber air inlet $326^1$ located in the first air inlet tube $362^1$ and a second air flow $375^2$ is shown passing through a second chamber air inlet $326^2$ located in the second air inlet tube $326^2$. The air flows $375^1$, $375^2$ pass on either side of the heater coil 318 and wick 319, which can reduce a cooling effect that the air flow has on the heater coil 318, as discussed herein. As shown in FIG. 12, the proximal ends of the air inlet tubes 3261, $326^2$ extend to a height that is even with a distal portion of the heater coil 318 and the wick 319 and are spaced apart from the heater coil 318. This can prevent heating, burning, and/or melting of the air inlet tubes $362^1$, $362^2$ as a result of heat produced from the heater coil 318. In some embodiments, the air inlet tubes $362^1$, $362^2$ can extend to a height that is less than the distal portion of the heater coil 318, although this can cause more air flow to come into contact with the heater coil 318 resulting in more cooling of the heater coil 318. Alternatively, the air inlet tubes $362^1$, $362^2$ can extend to a height that is even with or greater than a proximal portion of the heater coil 318 and the wick 319. In such an embodiment, the diameter of the heater coil 318 and/or wick 319 can be decreased and/or a space between the air inlet tubes $362^1$, $362^2$ can be increased to decrease or eliminate heating, burning, and/or melting the air inlet tubes $362^1$, $362^2$.

Also illustrated is reservoir 376, which can hold liquid that has not been vaporized by the heater coil 318. In an example, as discussed herein, a depth of the reservoir extends from the base plate portion 361 to the proximal ends of the air inlet tubes $362^1$, $362^2$. Condensate and/or leaked liquid can be collected in the reservoir 376, preventing it from migrating to other portions of the device 101-C.

In some embodiments, the chamber air inlets $326^1$, $326^2$ can be cylindrical. Alternatively, the chamber air inlets $326^1$, $326^2$ can be frustoconical. In an example, chamber air inlets $326^1$, $326^2$ that are frustoconical can provide an increased velocity of air flow, which can cause increased mixing of vapor and breaking apart of liquid droplets in the air stream. As such, a more favorable experience can be provided to the user. In an example, chamber air inlets $326^1$, $326^2$ that are frustoconical in shape can increase the velocity of the air flow as the air passes through the chamber air inlets $326^1$, $326^2$. For instance, a diameter of each chamber air inlet $326^1$, $326^2$ can be decreased from the distal end of each chamber air inlet $326^1$, $326^2$ to the proximal end of each chamber air inlet $326^1$, $326^2$. An increased velocity of the air flow can improve mixing of the air with vapor that is produced from the wick 319.

Figure 13:
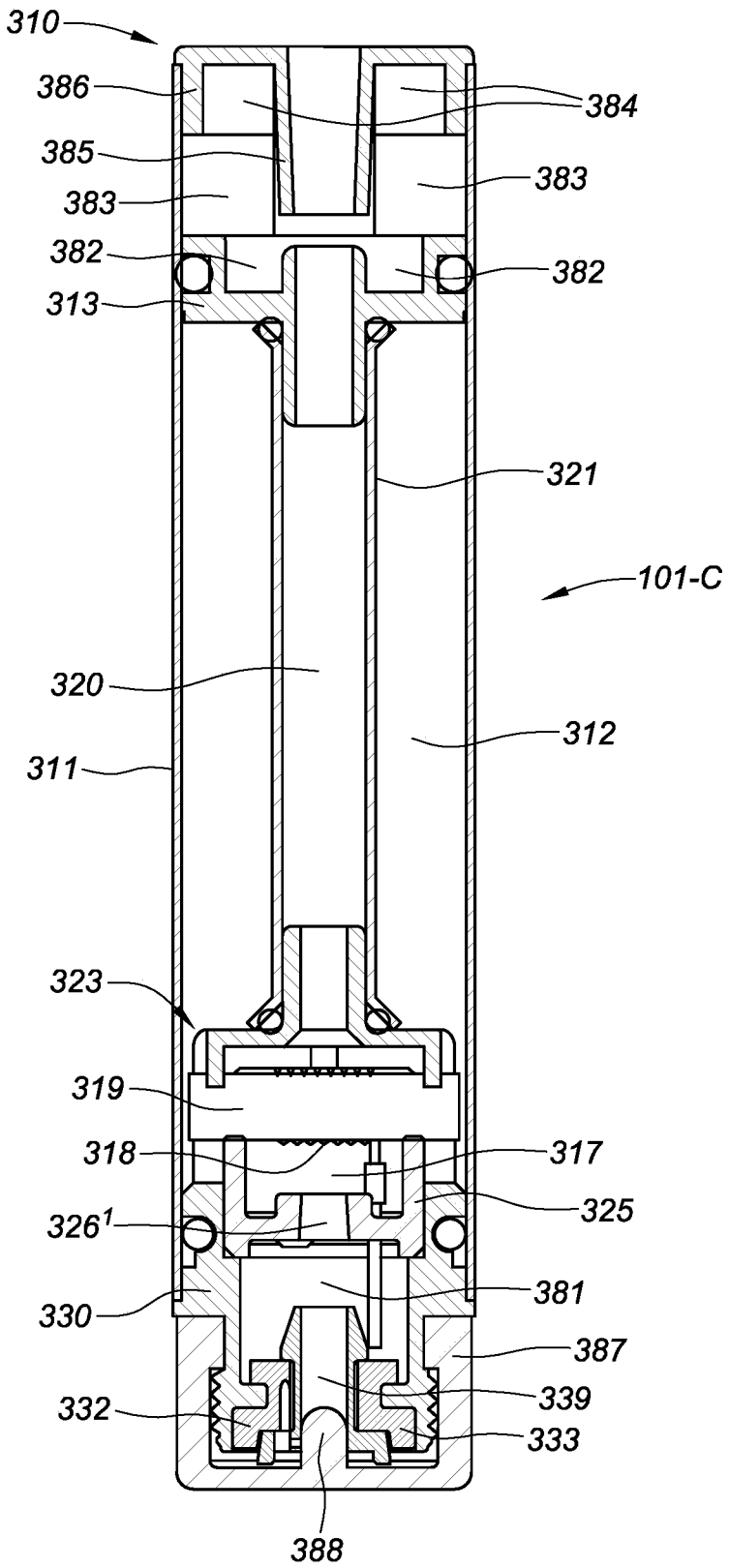
FIG. 13 depicts a cross-sectioned view of the side of the device depicted in FIGS. 1A-1C, in accordance with an alternate embodiment of the present disclosure.

FIG. 13 is a cross-sectioned view of the side of the device depicted in FIGS. 1A-1C, in accordance with an alternate embodiment of the present disclosure. As shown in FIG. 10, the device 101-C includes a mouth piece 310 inserted into a proximal end of an outer tube 311. The device 101-C can comprise a liquid media storage tank 312, which can be formed by the outer tube 311 and an inner tube 321, creating an annular space between the outer tube 311 and the inner tube 321. In some embodiments, a proximal seal 313 can be placed between the inner tube 321 and the mouth piece 310 and a perimeter of the proximal seal 313 can connect with an inner surface of the outer tube 311 to create a seal between the liquid media storage tank 312 and the mouth piece 310. As discussed in relation to FIG. 10, the proximal seal 313 can comprise an axially extending cylindrical tube and a flange extending radially from the axially extending cylindrical tube. A perimeter of the radially extending flange can be in contact with an inner wall of the outer tube 311. In some embodiments, the radially extending flange can extend radially from the cylindrical tube between a first and second end of the cylindrical tube. In some examples, a seal portion can extend axially from an outer edge of the radially extending flange and can include an annular groove around a perimeter of the seal portion in which a seal can be placed, as discussed further herein.

In some embodiments, an annular absorbent chamber 382 can be formed between the radially extending flange and a proximal end of the cylindrical tube of the proximal seal 313. The annular absorbent chamber 382 can be filled with an absorbent material, which can absorb condensate within the air path 320 before it reaches the mouth piece 310 and/or enters the user's mouth, as discussed herein. In some embodiments, a secondary annular absorbent chamber 383 can be formed between the mouth piece 310 and the proximal seal 313. The secondary annular absorbent chamber 383 can be filled with an additional absorbent material that can be the same as and/or a different absorbent material that is used to fill the annular absorbent chamber 382. In some embodiments, a mouth piece absorbent chamber 384 can be formed within the mouth piece 310. The mouth piece absorbent chamber 384 can be formed by and located between a mouth piece tube 385, which can be an axially extending cylindrical tube, and an outer wall 386 of the mouth piece. In some embodiments, a total amount of liquid that can be absorbed by the absorbent chambers 382, 383, 384 can be a total volume of between 0.05 milliliters of liquid to 5 milliliters of liquid. In an example, the total amount of liquid that can be absorbed can be approximately 0.22 milliliters of liquid.

The device 101-C can include the heater coil housing 323 and the heater coil support 325, which form the heater coil chamber 317, which houses the wick 319 and the heater coil 318. The chamber air inlet $326^1$ is illustrated as passing through the heater coil support 325. Chamber air inlet $326^2$ also passes through heater coil support 325, but is obscured by the heater coil support 325 in FIG. 13.

In some embodiments, the battery connector 330 is connected to a distal end of the outer tube 311 and can be connected with the heater coil support, as discussed herein. In some embodiments, a cover 387 can be placed around a connection portion of the battery connector 330 to protect connectors (e.g., threads, frictionally engaged connectors) associated with the battery connector 330. The cover 387 can include an air inlet plug 388 that can be inserted into the axial cylindrical air inlet opening 339. In an example, an absorbent material 381 can be placed in the air inlet chamber 348 located in the battery connector 330. As discussed herein, liquid that has not been vaporized can leak from the heater coil chamber 317. In some embodiments, the liquid can migrate through the chamber air inlets $326^1$, $326^2$ and can be absorbed by the absorbent material 381, preventing it from migrating through the axial cylindrical air inlet opening 339. The axial cylindrical air inlet opening 339 can pass through the center battery connect 333, which can be inserted into the insulator grommet 332. As discussed herein, the wire 342 can be connected to the center battery connect and to the heater coil 318 to provide power to the heater coil 318.

Figure 14:
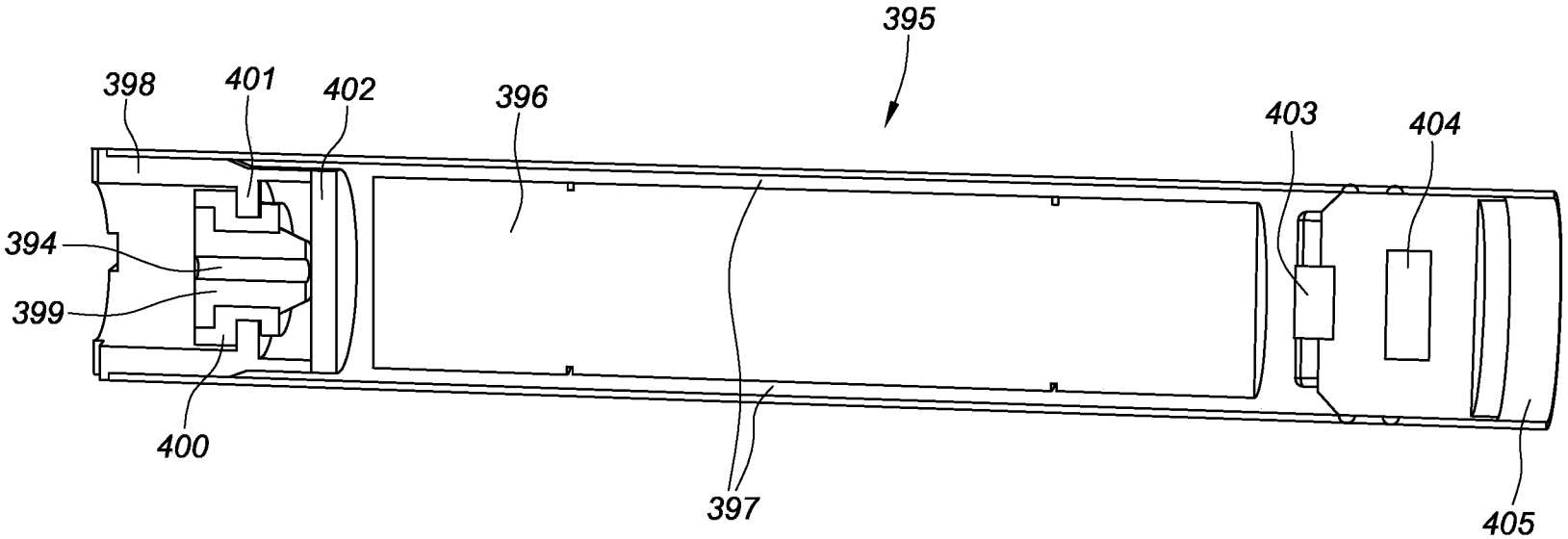
FIG. 14 depicts a cross-sectioned view of the side of a battery assembly, in accordance with embodiments of the present disclosure.

FIG. 14 is a cross-sectioned view of the side of a battery assembly 395, in accordance with embodiments of the present disclosure. In some embodiments, the battery assembly 395 can include a battery 396. Terminals of the battery 396 can be connected to the heater coil 318 to provide power to the heater coil 318. In some embodiments, the battery assembly 395 can include an annular air path 397 that surrounds the battery 396. In some examples, an air path 397 can pass along one side of the battery 396. The battery assembly 395 can be connected to the device 101, 101-C via a battery connector 398. The battery connector 398 can include a connector portion that is complimentary to the device battery connector (e.g., battery connector 330 of the device 101, 101-C). As a user draws on the mouth piece 310 of the device 101, 101-C, air can be drawn through a center battery connect 399, which includes an axial cylindrical hole 394 passing there through, which is in communication with the air path 397. In some embodiments, the center battery connect 399 can be inserted into an insulator grommet 400, which is held in place via an annular ridge 401 extending around an interior of the battery connector 398. In an example, the battery assembly 395 can include an absorbent disk 402 located between the battery connector 398 and the battery 396. If liquid leaks from the device 101, 101-C, as discussed herein, the liquid may migrate through the axial cylindrical hole passing through the center battery connect 399. As such, any liquid that does migrate through the hole can be absorbed by the absorbent disk, thus preventing interference with electronic components (e.g., battery 396, sensor 404) and/or a short circuit from occurring. As depicted in FIG. 14, the absorbent disk can define a plane that is transverse to a longitudinal axis of the battery assembly 395.

In some embodiments, a semi-permeable membrane 403 can be included between the battery 396 and a distal end of the battery assembly 395. The semipermeable membrane 403 can allow air to pass through, but can block liquid from passing through. In some embodiments, air can be drawn through a distal cap 405 associated with the battery assembly, through the semipermeable membrane 403, into the air path 397 and through the axial cylindrical hole 394 passing through the center battery connect 399. As such, air can flow over the sensor 404, which in some embodiments can be a microphone, pressure sensor, mass air flow sensor, mechanical switch, etc. The sensor 404 can detect that air is flowing over the sensor, indicating that a user is using the device, and cause the battery 396 to provide power to the heater coil. In some embodiments, the semipermeable membrane 403 can extend across an opening in the battery assembly 395 between the battery 396 and the sensor 404. As such, if liquid that has not been vaporized migrates through the battery assembly 395 toward the distal cap 405 of the battery assembly 395, the semipermeable membrane 403 can prevent the liquid from reaching the sensor 404, while still allowing air to pass through the semipermeable membrane 403. As depicted in FIG. 14, the semi-permeable membrane can define a plane that is transverse to a longitudinal axis of the battery assembly 395.

Some embodiments of the present disclosure can include an anti-leaking algorithm that can detect a liquid short of the sensor and shut down the heater. For example, embodiments of the present disclosure can include a computer readable medium executed by a computer (e.g., processing device) that stores instructions to detect a liquid short of the sensor and shut down the heater. In an example, liquid can short circuit the sensor 404 and can power off the heater until a puff duration is exceeded. The battery can continue to give a false dead battery indication. In an example, the instructions can include instructions to analyze what an electrical signal from the sensor 404 looks like under normal operation and what an electrical signal from the sensor 404 looks like when the sensor 404 has been short circuited.

Figure 15A:
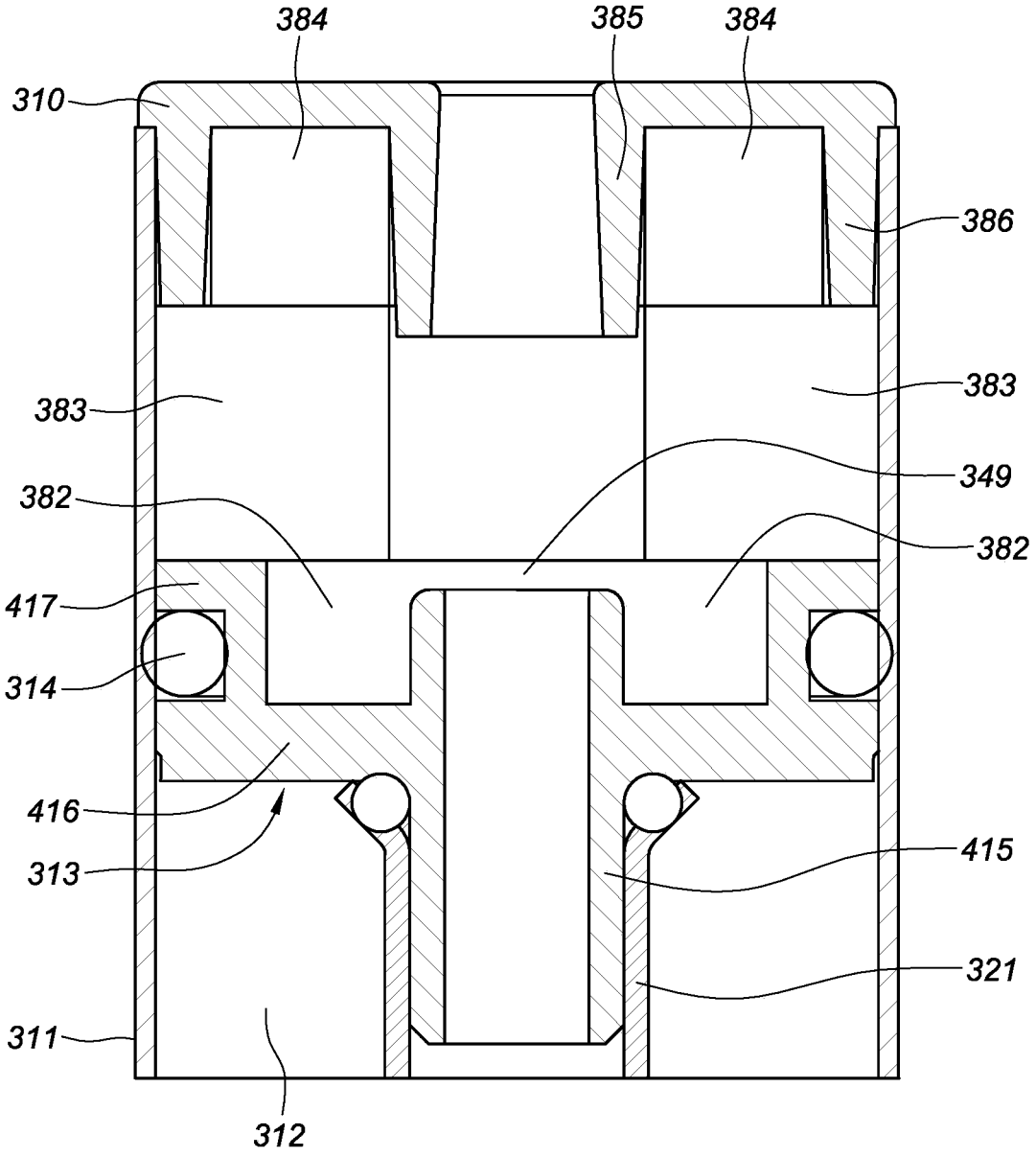
FIG. 15A depicts a cross-sectioned view of a proximal end of a device for storing and vaporizing liquid media, in accordance with embodiments of the present disclosure.

FIG. 15A is a cross-sectioned view of a proximal end of the device depicted in FIGS. 10 and 13. In some embodiments, a proximal seal 313 can be placed between the inner tube 321 and the mouth piece 310 and a perimeter of the proximal seal 313 can connect with an inner surface of the outer tube 311 to create a seal between the liquid media storage tank 312 and the mouth piece 310. In an example, the proximal seal 313 can comprise a proximal seal tube, which can be an axially extending cylindrical tube 415, and a flange 416 extending radially from the axially extending cylindrical tube 415. A perimeter of the radially extending flange 416 can be in contact with an inner wall of the outer tube 311. In some embodiments, the radially extending flange 416 can extend radially from the cylindrical tube 415 between a first and second end of the cylindrical tube. In some examples, a seal portion 417 can extend axially from an outer edge of the radially extending flange 416 and can include an annular groove around a perimeter of the seal portion in which a seal can be placed. For example, a rubber o-ring 314 can be placed in the annular groove. In some examples, the axially extending seal portion 417 can extend towards the mouth piece 310, leaving an annular absorbent chamber 382 between the mouth piece 310 and the radially extending flange 416. In some embodiments, the annular absorbent chamber 382 can be left empty. Alternatively, as illustrated in FIG. 15B, absorbent material 425 can be placed in the annular absorbent chamber.

In some embodiments, a secondary annular absorbent chamber 383 can be formed between the mouth piece 310 and the proximal seal 313. The secondary annular absorbent chamber 383 can be filled with an additional absorbent material that can be a same as and/or a different absorbent material than that used to fill the annular absorbent chamber 382. In some embodiments, a mouth piece absorbent chamber 384 can be formed within the mouth piece 310. The mouth piece absorbent chamber 384 can be formed by and located between a mouth piece tube 385, which can be an axially extending cylindrical tube, and an outer wall 386 of the mouth piece 310. The absorbent material placed in the secondary annular absorbent chamber 383 and the mouth piece absorbent chamber 384 can be annular in shape, such that an axial cylindrical air path extends through the absorbent materials from the inner tube 321. As discussed herein, a gap 349 can exist between the proximal end of the cylindrical tube 415 and the absorbent material 383, such that droplets traveling up an inner wall of the inner tube 321 do not bridge the gap 349. In an example, the gap 349 can be approximately 1 millimeter long. For example, the gap 349 can have an axial length in a range of 0.5 millimeters to 1.5 millimeters. However, the gap 349 can be shorter or longer than 1 millimeter long in some embodiments.

In some embodiments, the absorbent material that fills the secondary annular absorbent chamber 383 can be a porous material, such as a Porex disk that is between 0.1 and 7 millimeters thick, for example, 3 millimeters thick. In some embodiments, the absorbent material that fills the mouth piece absorbent chamber 384 can be a porous material, such as a Porex disk that is between 0.1 and 6 millimeters thick, for example, 2.1 millimeters thick.

Figure 15B:
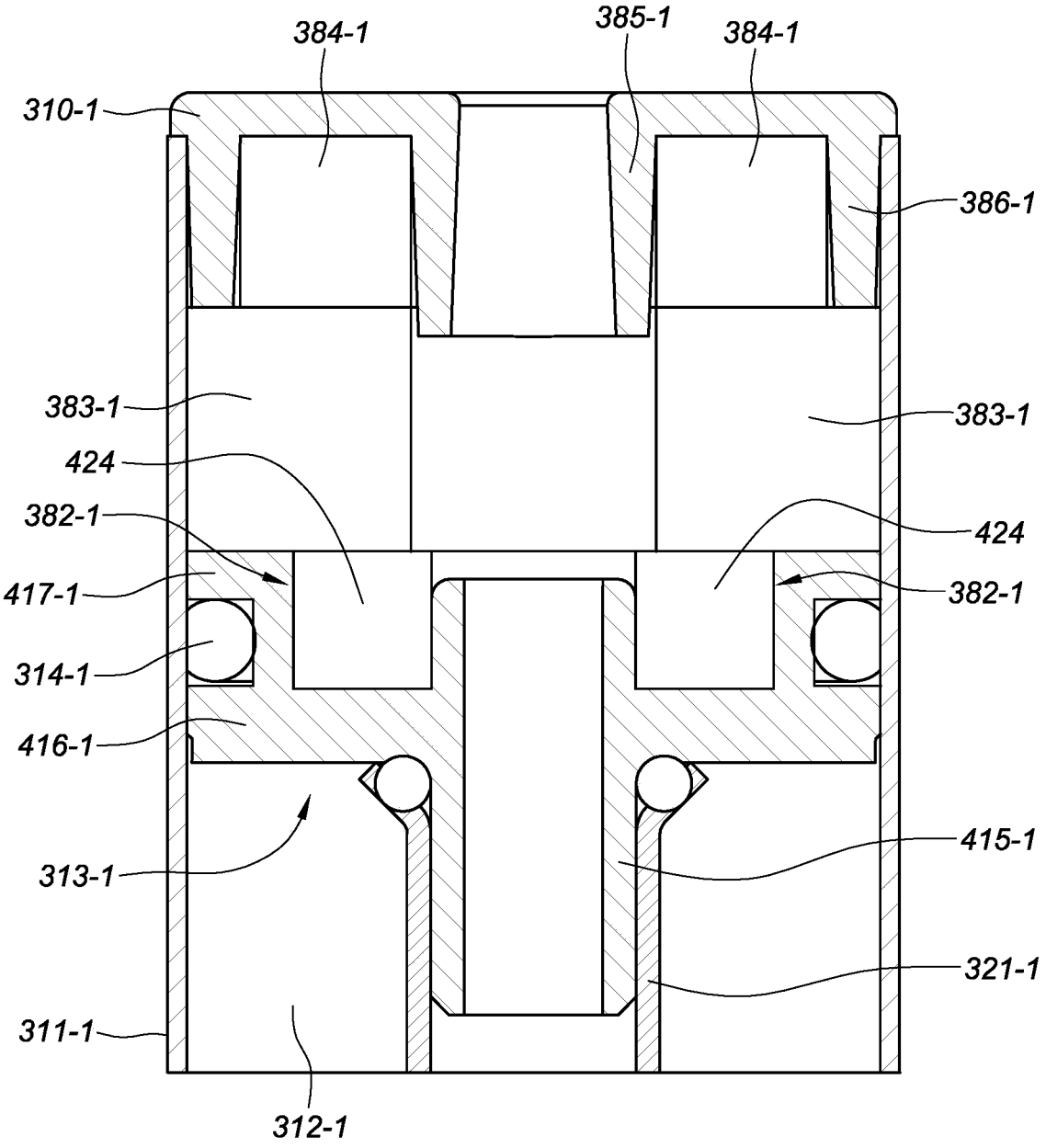
FIG. 15B depicts a cross-sectioned view of an alternate embodiment of a proximal end of a device for storing and vaporizing liquid media, in accordance with embodiments of the present disclosure.

FIG. 15B is a cross-sectioned view of an alternate embodiment of a proximal end of a device for storing and vaporizing liquid media, in accordance with embodiments of the present disclosure. As discussed herein, the annular absorbent chamber 382-1 can be filled with an absorbent material 424. The absorbent material 424 can be cotton in some embodiments and/or a porous material that can absorb liquid. In some embodiments, the absorbent material that fills the secondary annular absorbent chamber can be a porous material, such as a Porex disk that is between 0.1 and 7 millimeters thick, for example, 3 millimeters thick. In some embodiments, the absorbent material that fills the mouth piece absorbent chamber can be a porous material, such as a Porex disk that is between 0.1 and 6 millimeters thick, for example, 2.1 millimeters thick.

As discussed herein, in some embodiments, a proximal seal 313-1 can be placed between the inner tube 321-1 and the mouth piece 310-1 and a perimeter of the proximal seal 313-1 can connect with an inner surface of the outer tube 311-1 to create a seal between the liquid media storage tank 312-1 and the mouth piece 310-1. In an example, the proximal seal 313-1 can comprise a proximal seal tube, which can be an axially extending cylindrical tube 415-1, and a flange 416-1 extending radially from the axially extending cylindrical tube 415-1. In some examples, a seal portion 417-1 can extend axially from an outer edge of the radially extending flange 416-1 and can include an annular groove around a perimeter of the seal portion in which a seal 314-1 can be placed. For example, a rubber o-ring can be placed in the annular groove. In some examples, the axially extending seal portion 417-1 can extend towards the mouth piece 310-1, leaving the annular absorbent chamber 382-1 between the mouth piece 310-1 and the radially extending flange 416-1.

In some embodiments, a secondary annular absorbent chamber 383-1 can be formed between the mouth piece 310-1 and the proximal seal 313-1. The secondary annular absorbent chamber 383-1 can be filled with an additional absorbent material that can be a same as and/or a different absorbent material than that used to fill the annular absorbent chamber 382-1. In some embodiments, a mouth piece absorbent chamber 384-1 can be formed within the mouth piece 310-1, as discussed herein. The mouth piece absorbent chamber 384-1 can be formed by and located between a mouth piece tube 385-1 and an outer wall 386-1 of the mouth piece 310-1. As discussed herein, a gap can exist between the proximal end of the cylindrical tube 415-1 and the absorbent material 383-1, such that droplets traveling up an inner wall of the inner tube 321-1 do not bridge the gap.

Figure 15C:
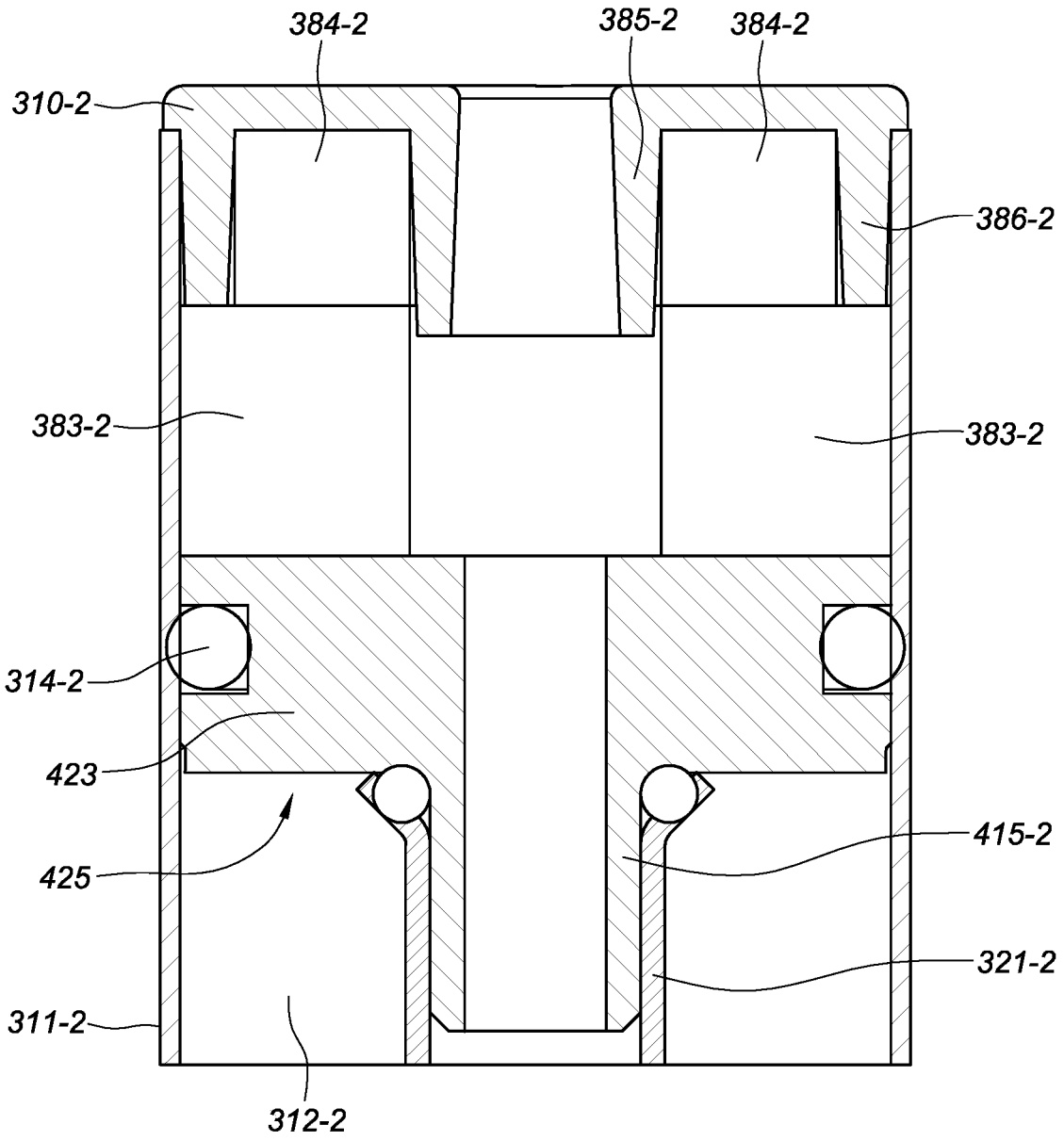
FIG. 15C depicts a cross-sectioned view of an alternate embodiment of a proximal end of a device for storing and vaporizing liquid media, in accordance with embodiments of the present disclosure.

FIG. 15C is a cross-sectioned view of an alternate embodiment of a proximal end of a device for storing and vaporizing liquid media, in accordance with embodiments of the present disclosure. In some embodiments, a proximal seal 425 can be placed between the inner tube 321-2 and the mouth piece 310-2 and a perimeter of the proximal seal 425 can connect with an inner surface of the outer tube 311-2 to create a seal between the liquid media storage tank 312-2 and the mouth piece 310-2. In an example, the proximal seal 425 can comprise a proximal seal tube, which can be an axially extending cylindrical tube 415-2, and a flange 423 extending radially from the axially extending cylindrical tube 415-2. A perimeter of the radially extending flange 423 can be in contact with an inner wall of the outer tube 311. In some embodiments, the radially extending flange 423 can extend radially from the cylindrical tube 415-2 between a first and second end of the cylindrical tube 415-2. As shown in FIG. 15C, the radially extending flange 423 can extend from the proximal end of the axially extending cylindrical tube 415-2 to a generally middle portion of the axially extending cylindrical tube 415-2, such that the proximal seal 425 does not include an annular absorbent chamber, as shown in FIGS. 15A and 15B. As shown in FIG. 15C, the flange 423 can include an annular groove around a perimeter of the seal portion in which a seal 314-2 (e.g., o-ring) can be placed. In some embodiments, the absorbent material that fills the secondary annular absorbent chamber 383-2 can be a porous material, such as a Porex disk that is between 0.1 and 7 millimeters thick, for example, 3 millimeters thick. In some embodiments, the absorbent material that fills the mouth piece absorbent chamber 384-2 formed between the mouth piece tube 385-2 and outer wall 386-2 of the mouth piece 310-2 can be a porous material, such as a Porex disk that is between 0.1 and 6 millimeters thick, for example, 2.1 millimeters thick.

Figure 15D:
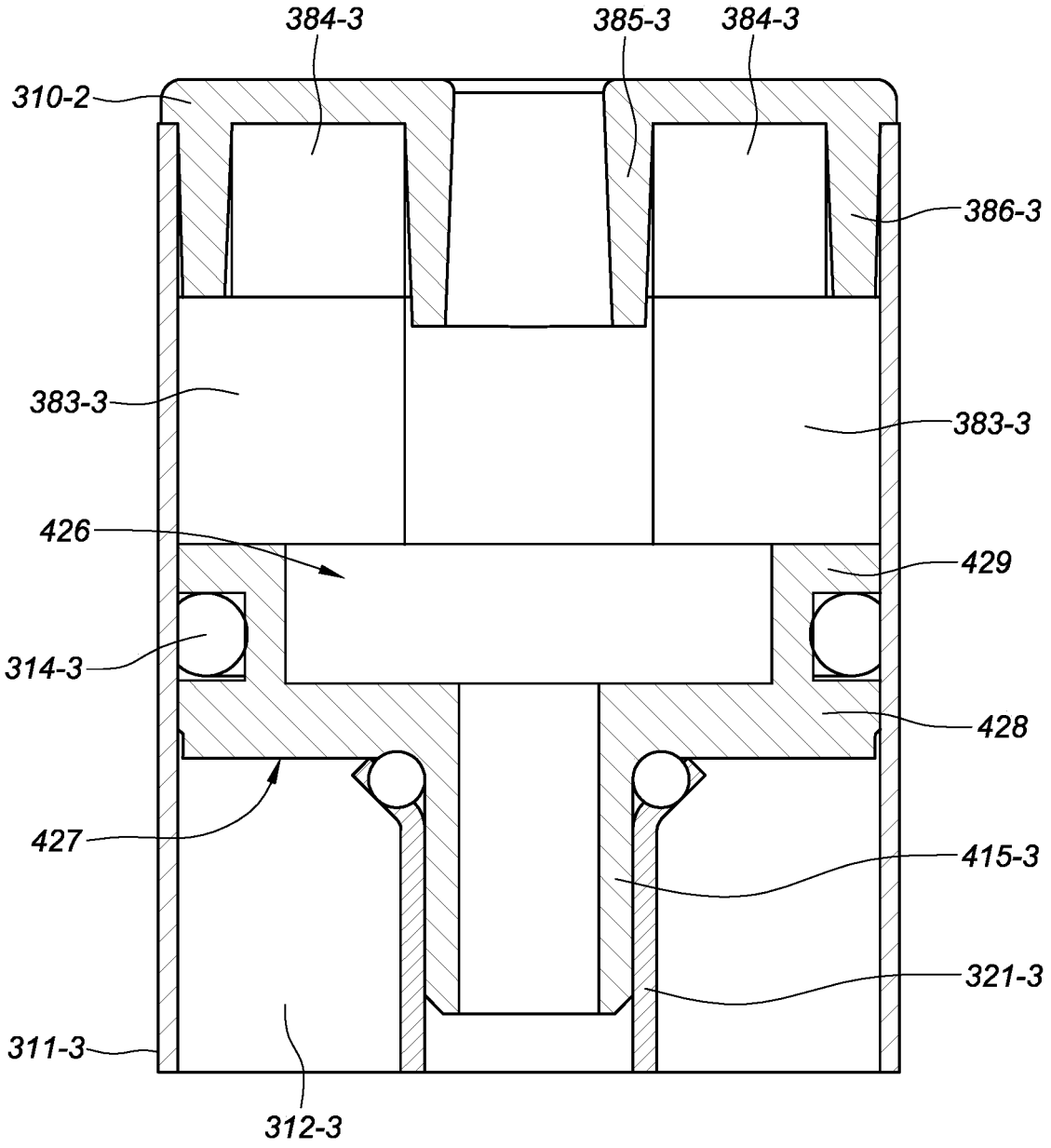
FIG. 15D depicts a cross-sectioned view of an alternate embodiment of a proximal end of a device for storing and vaporizing liquid media, in accordance with embodiments of the present disclosure.

FIG. 15D is a cross-sectioned view of an alternate embodiment of a proximal end of a device for storing and vaporizing liquid media, in accordance with embodiments of the present disclosure. In some embodiments, a proximal seal 427 can be placed between the inner tube 321-3 and the mouth piece 310-3 and a perimeter of the proximal seal 427 can connect with an inner surface of the outer tube 311-3 to create a seal between the liquid media storage tank 312-3 and the mouth piece 310-3. In an example, the proximal seal 427 can comprise a proximal seal tube, which can be an axially extending cylindrical tube 415-3, and a flange 428 extending radially from the axially extending cylindrical tube 415-3. A perimeter of the radially extending flange 428 can be in contact with an inner wall of the outer tube 311-3. In some embodiments, the radially extending flange 428 can extend radially from the cylindrical tube 415-3 at a proximal end of the cylindrical tube 415-3, as shown in FIG. 15D. In some examples, a seal portion 429 can extend axially from an outer edge of the radially extending flange and can include an annular groove around a perimeter of the seal portion 429 in which a seal 314-3 can be placed. For example, a rubber o-ring can be placed in the annular groove. In some examples, the axially extending seal portion 429 can extend towards the mouth piece 310-3, leaving an empty cylindrical space between the mouth piece 310-3 and the radially extending flange 428, as further discussed herein. In an example, a chamber 426 can be formed between the axially extending seal portion 429 that extends from the outer edge of the radially extending flange 428. In some embodiments, the chamber 426 can be left empty, and/or can be filled with an absorbent material. In some embodiments, the absorbent material that fills the secondary annular absorbent chamber 383-3 can be a porous material, such as a Porex disk that is between 0.1 and 7 millimeters thick, for example, 3 millimeters thick. In some embodiments, the absorbent material that fills the mouth piece absorbent chamber 384-3 formed between the mouth piece tube 385-3 and the outer wall 386-3 of the mouth piece 310-3 can be a porous material, such as a Porex disk that is between 0.1 and 6 millimeters thick, for example, 2.1 millimeters thick.

Figure 16:
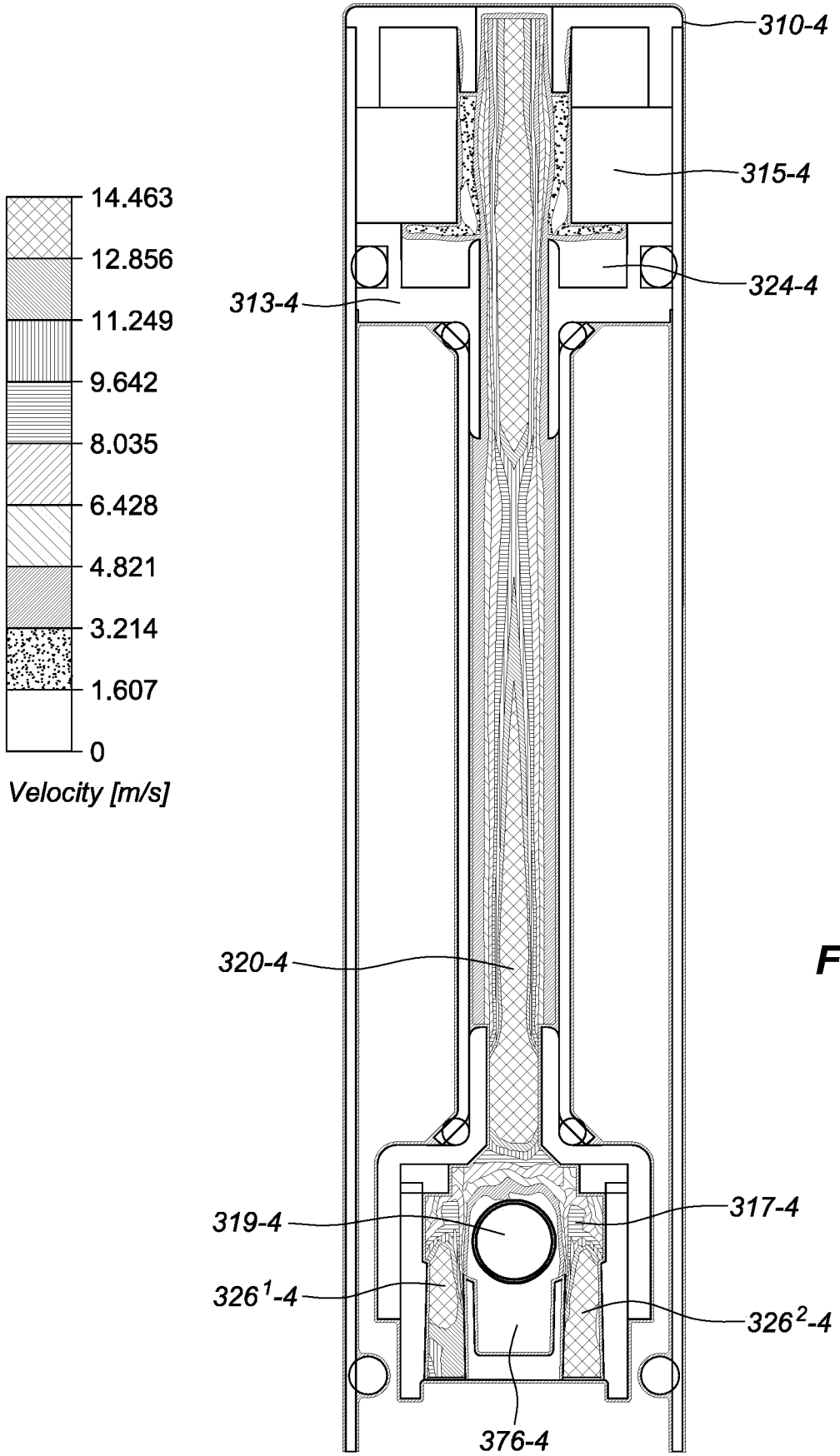
FIG. 16 depicts a side view of the device depicted in FIG. 10 for storing and vaporizing liquid media and depicts representative flow velocities at various locations along a flow path, in accordance with embodiments of the present disclosure.

FIG. 16 is a side view of the device depicted in FIG. 10 for storing and vaporizing media and depicts representative flow velocities at various locations along a flow path, in accordance with embodiments of the present disclosure. Velocities of the air flow are represented by the velocity chart in FIG. 16. In an example, the air can flow through the chamber air inlets and into the heater coil chamber. As illustrated, in some embodiments, a velocity of an air flow entering one of the chamber air inlets can be slower than a velocity of air flowing into another one of the chamber air inlets. In an example, this can be caused by an air inlet hole that allows air to flow into the air inlet chamber. In an example, the air inlet chamber can be located more proximately to one of the chamber air inlets, causing the difference in velocities.

A flow velocity through various portions of the device can be dependent on an amount of air that is drawn through the mouth piece and is thus pulled through the chamber air inlets 326$^1$-4, 326$^2$-4. As depicted in FIG. 16, the flow velocities represented can be associated with a greatest flow velocity passing through the mouth piece 310-4 in a range of approximately 12 to 15 meters per second (m/s). As depicted in FIG. 16, the flow velocity in the heater coil chamber 317-4 can generally be less than the flow velocity in each of the chamber air inlets 326$^1$-4, 326$^2$-4. As air passes from each of the chamber air inlets 326$^1$-4, 326$^2$-4 around the wick 319-4, the flow velocity of the air can generally decrease and the air can mix with the vapor produced by the liquid media being vaporized.

The flow velocity in the reservoir 376-4 can be less than the surrounding heater coil chamber 317-4 and the chamber air inlets 326$^1$-4, 326$^2$-4. In some embodiments, the flow velocity in the reservoir 376-4 can be zero or close to zero. In some embodiments, some swirling effects can be present in the reservoir 376-4, however, air in the reservoir can generally be stagnant. For example, the flow velocity in the reservoir 376-4 can allow for any condensate and/or liquid that has not been vaporized to coalesce in the reservoir 376-4, preventing it from being drawn into a user's mouth or negatively interacting with components of the device (e.g., causing a short circuit).

As the mixture of vapor and air passes through the air path 320-4, the flow velocity of the mixture can be increased, which can promote mixing of the vapor and air. In some embodiments, as depicted in FIG. 10, the air path 320-4 can be configured to decrease the flow velocity of the mixture, as it approaches the proximal seal 313-4. As depicted in FIG. 10, an inner diameter of the proximal seal tube can be smaller than an inner diameter of the inner tube, causing a decrease in the diameter of the air path 320-4. In some embodiments, the decrease in the diameter of the air path 320-4 can result in the decrease in the flow velocity of the mixture. As depicted in FIG. 16, the mixture can enter the gap between the expansion chamber 324-4 and the first porous material 315-4 with a decreased flow velocity over that associated with the air path 320-4.

Figure 17:
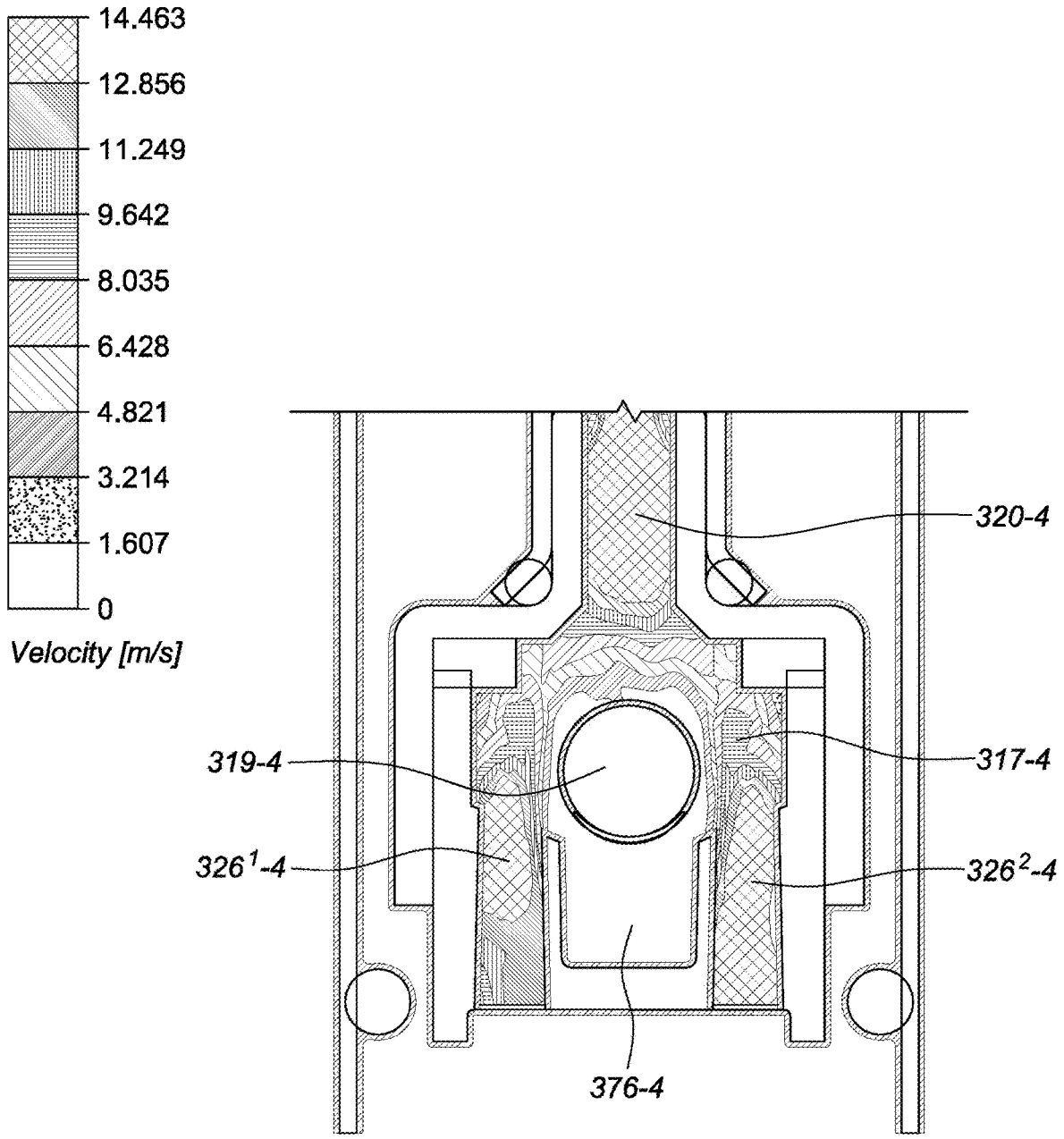
FIG. 17 depicts a side view of the device depicted in FIG. 10 for storing and vaporizing media and depicts representative flow velocities at various locations along a flow path, in accordance with embodiments of the present disclosure.

FIG. 17 is a side view of the device depicted in FIG. 10 for storing and vaporizing media and depicts representative flow velocities at various locations along a flow path, in accordance with embodiments of the present disclosure. FIG. 17 illustrates a close-up view of the heater coil chamber 317-4 and chamber air inlets 326$^1$-4, 326$^2$-4 and velocities associated therewith. Velocities of the air flow are represented by the velocity chart in FIG. 17. In an example, the air can flow through the chamber air inlets and into the heater coil chamber. As illustrated, in some embodiments, a velocity of an air flow entering one of the chamber air inlets can be slower than a velocity of air flowing into another one of the chamber air inlets. In an example, this can be caused by an air inlet hole that allows air to flow into the air inlet chamber. In an example, the air inlet chamber can be located more proximately to one of the chamber air inlets, causing the difference in velocities.

As depicted in FIG. 17, the flow velocity around the wick 319-4 can be approximately zero. This can be due to the positioning of the chamber air inlets 326$^1$-4, 326$^2$-4 with respect to the wick 319-4. For example, the chamber air inlets 326$^1$-4, 326$^2$-4 can be positioned on either side of the wick 319-4. As air passes from each of the chamber air inlets 326$^1$-4, 326$^2$-4, a low flow velocity area can be created around the wick 319-4, which can prevent the wick 319-4 and associated heating element from being cooled by the intake of air into the device. As further depicted, the flow velocity can be reduced in the heater coil chamber 317-4 and can be increased as a mixture of air and/or vapor is drawn into the air path 320-4.

Figure 18A:
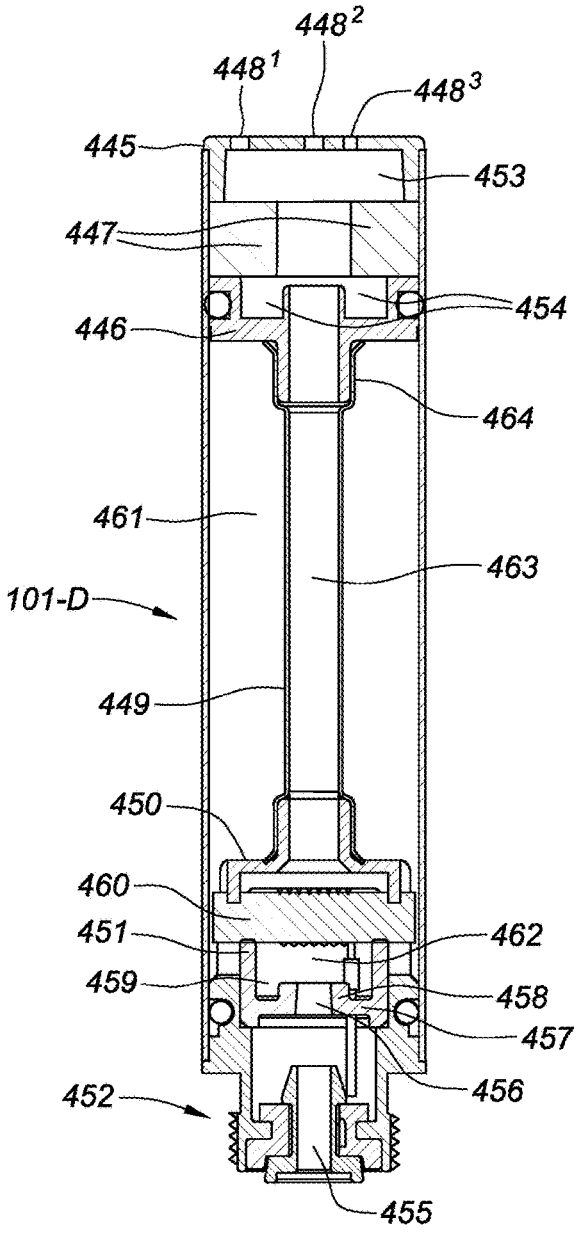
FIG. 18A depicts a cross-sectioned side view of an alternate embodiment of a device for storing and vaporizing liquid media, in accordance with embodiments of the present disclosure.
Figure 18B:
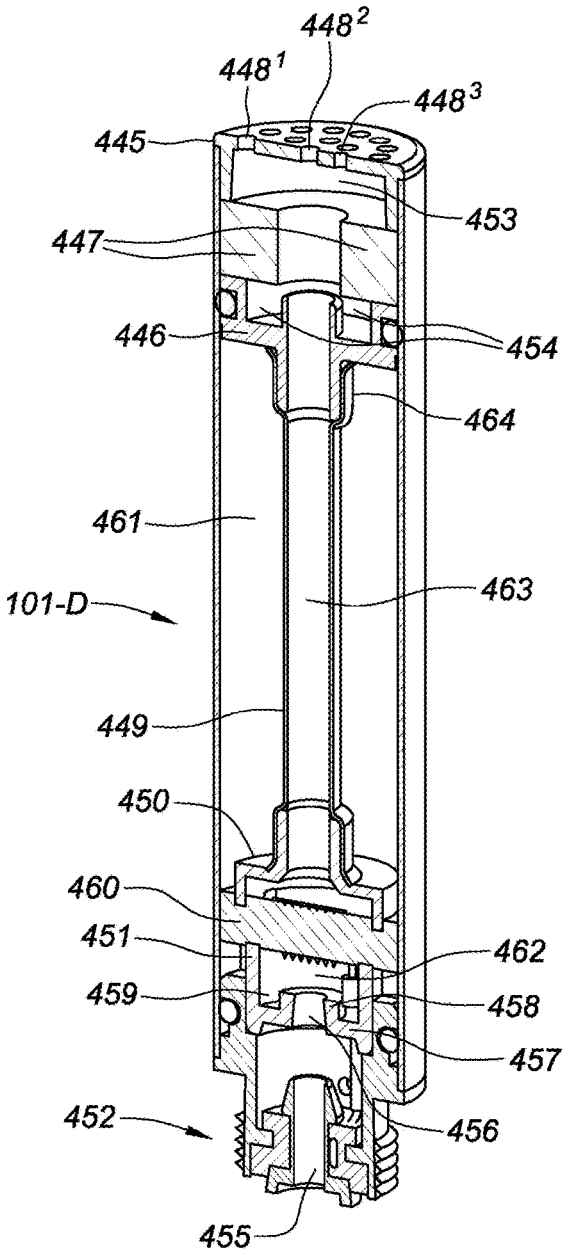
FIG. 18B depicts a cross-sectioned isometric top and side view of an alternate embodiment of a device for storing and vaporizing liquid media, in accordance with embodiments of the present disclosure.

FIG. 18A depicts a cross-sectioned side view of an alternate embodiment of a device 101-D for storing and vaporizing liquid media, in accordance with embodiments of the present disclosure. FIG. 18B depicts a cross-sectioned isometric top and side view of an alternate embodiment of a device 101-D for storing and vaporizing liquid media, in accordance with embodiments of the present disclosure. In some embodiments, air can be drawn through an axial cylindrical air inlet opening 455 through a chamber air inlet 456. The chamber air inlet 456 can include a central axial passageway that extends through a base plate portion 457 of the heater coil support 451. In some embodiments, the chamber air inlet 456 can be partially formed by an axial cylindrical tube 458 that extends proximally along a longitudinal axis of the device 101-D from the base plate portion 457, as depicted in FIG. 18A. The axial cylindrical tube 458 can serve multiple purposes. In some embodiments, the axial cylindrical tube 458 can direct a flow of air towards the wick 460. In some embodiments, the axial cylindrical tube 458 can form an annular reservoir 459 around an exterior surface of the axial cylindrical tube 458. The annular reservoir 459 can collect liquid that enters the heater coil chamber 462 from the liquid media storage tank 461. In an example, liquid can leak from the liquid storage tank 461 along the walls of the heater coil support 451 and can coalesce in the annular reservoir 459, which can prevent the liquid from migrating to other portions of the device 101-D.

The air can contact the wick and an associated heating element, which can vaporize the liquid to form a mixture of air and vapor. The mixture of air and vapor can travel from the heater coil chamber 462 through the heater coil housing 450 into the inner tube 449, which forms an air path 463. In some embodiments, the inner tube 449 can be connected with a proximal seal 446, as discussed herein. The air and vapor mixture can pass through an axially extending cylindrical tube 464 in the proximal seal 446. In some embodiments, as discussed herein, the proximal seal 446 can include an expansion chamber 454. In some embodiments, the liquid that has condensed along the walls of the inner tube 449 can be drawn into the expansion chamber 454, which can serve as a reservoir for the liquid, preventing the liquid from entering a user's mouth. The mixture of air and vapor can pass through an axial opening of a first absorbent material 447 (e.g., a porous material) into a second expansion chamber 453 before exiting the mouth piece 445. In some embodiments, the mouth piece 445 can include a plurality of outlets 448$^1$, 448$^2$, 448$^3$, which are shown as cross-sections in FIG. 18A. In some embodiments, the plurality of outlets 448$^1$, 448$^2$, 448$^3$ can have diameters in a range from 0.5 millimeters to 1 millimeter. The number of outlets 448$^1$, 448$^2$, 448$^3$ can range in number depending on their respective size. For example, in some embodiments, the outlets 448$^1$, 448$^2$, 448$^3$ can range in number from 5 to 40 outlets. In some embodiments, the outlets can range in number from 15 to 30. In some embodiments, the mouth piece 445 can include 23 outlets.

Figure 19A:
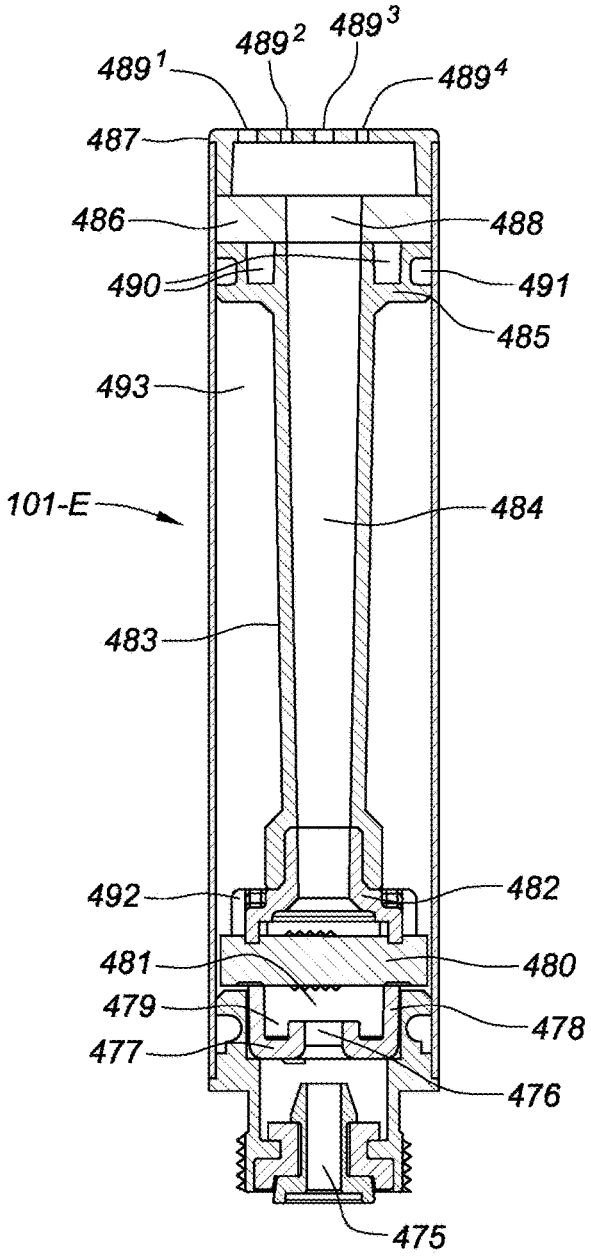
FIG. 19A depicts a cross-sectioned side view of an alternate embodiment of a device for storing and vaporizing liquid media, in accordance with embodiments of the present disclosure.
Figure 19B:
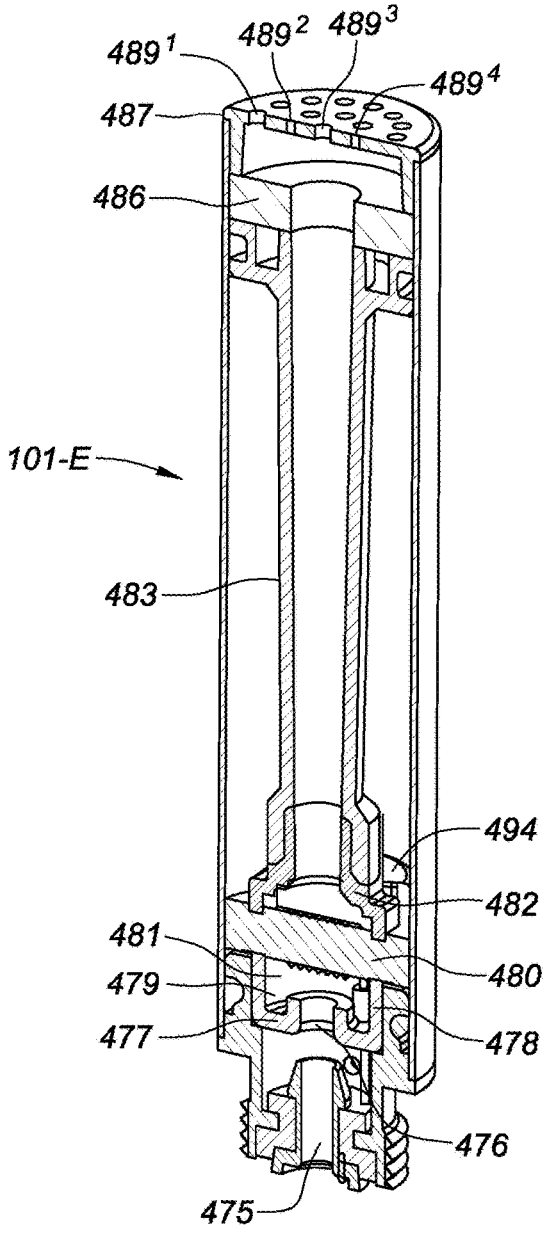
FIG. 19B depicts a cross-sectioned isometric top and side view of an alternate embodiment of a device for storing and vaporizing liquid media, in accordance with embodiments of the present disclosure.

FIG. 19A depicts a cross-sectioned side view of an alternate embodiment of a device for storing and vaporizing liquid media, in accordance with embodiments of the present disclosure. FIG. 19B depicts a cross-sectioned isometric top and side view of an alternate embodiment of a device for storing and vaporizing liquid media, in accordance with embodiments of the present disclosure. In some embodiments, air can be drawn through an axial cylindrical air inlet opening 475 through a chamber air inlet 476. The chamber air inlet 476 can include a central axial passageway that extends through a base plate portion 477 of the heater coil support 478, as discussed herein. In some embodiments, an annular reservoir 479 can be partially formed, as discussed in relation to FIGS. 18A and 18B. In some embodiments, an absorbent material can be placed in the annular reservoir 479.

The air can contact a wick 480 and an associated heating element, which can vaporize liquid drawn from liquid media storage tank to form a mixture of air and vapor. The mixture of air and vapor can travel from the heater coil chamber 481 through the heater coil housing 482 into the inner tube 483, which forms an air path 464. In some embodiments, the heater coil housing 482 can be connected with the inner tube 483 without use of a seal, such as an o-ring as discussed in relation to FIG. 10. For instance, as depicted in FIGS. 19A and 19B, the heater coil housing 482 and the inner tube 483 can include an interference fit. The interference fit can be configured to provide a water and gas tight seal between the inner tube 483 and the heater coil housing 482.

In some embodiments, a groove 492 can be formed in the heater coil housing 482, which can be configured to allow liquid stored in the liquid media storage tank 493 to flow towards the wick 480. In some embodiments, the groove 492 can extend proximally from a port from which the wick 480 extends into the liquid media storage tank 493. As depicted, the groove 492 can be approximately a same width as the port through which the wick 480 passes through. In some embodiments, the width of the groove 492 can be wider or narrower than a diameter of the port 480. In some embodiments, the groove 492 can extend proximally from the ports through which the wick 480 passes and can extend into a top surface 494 of the heater coil housing 482 towards a central longitudinal axis of the heater coil housing 482, as depicted in FIG. 19B.

In some embodiments, the inner tube 483 can have a distal end that has a diameter that is less than a proximal end of the inner tube 483. The difference in diameter between the proximal end of the inner tube 483 and the distal end of the inner tube 483 can slow a velocity of the air and vapor mixture as it flows through the inner tube 483. In an example, a diameter of the inner tube 483 can increase from the heater coil housing 482 to prevent condensation of the air and vapor mixture on the walls of the inner tube 483. As the diameter of the inner tube 483 increases, a velocity of the air and vapor mixture can decrease, slowing the flow of the air and vapor mixture. As discussed herein, the inner tube 483 can be connected to the proximal seal 485. The proximal seal 485 can include an expansion chamber 490, as previously described herein. The annular expansion chamber 490 can provide an area for condensate to collect. The proximal seal can include an annular groove 491 that extends around a perimeter of the proximal seal 485. In some embodiments, the annular groove 491 can extend around a perimeter of the proximal seal 485, as discussed herein. In some embodiments, a seal can be placed in the annular groove 491.

In some embodiments, the device 101-E can include an absorbent material 486 disposed between the proximal seal 485 and the mouth piece 487. The absorbent material 486 can include an axial cylindrical cutout 488 in-line with the air path 484. The axial cylindrical cutout 488 can provide a passageway for air from the air path 484 to the mouth piece 487. If condensate does form on the walls of the inner tube 483, the condensate can be drawn up the wall with the flow of air and can contact the absorbent material 486 and can be absorbed into the absorbent material 486, rather than being introduced into the user's mouth. As discussed herein, the mouth piece can include a plurality of outlets $448^1$, $448^2$, $448^3$, $489^4$, which can range in number depending on their respective size.

Embodiments are described herein of various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment", or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Although at least one embodiment of a device for storing and vaporizing liquid media has been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The invention claimed is:

1. A pod for use with an electronic smoking device, comprising:
   - a housing containing a liquid;
   - an inner tube within the housing;
   - a coil support at a first end of the housing;
   - the coil support having a base plate and curved sidewalls extending up from the base plate;
   - first and second notches in the curved sidewalls, each notch having an open end;
   - a heater coil wound around a wick having first and second ends extending through the first and second notches, respectively; and
   - first and second electrical contacts extending through first and second openings in the base plate, the first and second electrical contacts electrically adjoining first and second ends of the heater coil.

2. The pod of claim 1 wherein the heater coil is in the coil support, and the notches are at a first end of the curved sidewalls.

3. The pod of claim 2 further including a heater coil housing having complementary first and second notches aligned with the first and second notches in the curved sidewalls of the coil support, and wherein a first end of the inner tube extends into the heater coil housing.

4. The pod of claim 1 further including a liquid reservoir formed by the base plate and the curved sidewalls, below the heater coil.

5. The pod of claim 3 further including a first seal sealing a first end of an inner tube to the heater coil housing.

6. The pod of claim 5 further including a second seal sealing the coil support against an inner surface of the housing, at the first end of the housing.

7. The pod of claim 1 further including first and second air inlets through the base plate on opposite sides of the heater coil.

8. The pod of claim 3 with the complementary first and second notches of the heater coil housing and the first and second notches in the curved sidewalls of the coil support forming first and second wick ports having a diameter less than the diameter of the wick.

9. The pod of claim 8 with first and second ends of the wick extending out of the first and second wick ports.

10. The pod of claim 8 with the wick held in place between the heater coil housing and the coil support.

11. The pod of claim 3 with the inner tube having sidewalls that flare conically outwardly at a second end of the inner tube.

12. The pod of claim 1 further including a mouthpiece on a second end of the housing.

13. A pod for use with an electronic smoking device, comprising:

a housing containing a liquid;

a coil support at a first end of the housing;

the coil support having curved sidewalls extending up from a base plate;

first and second notches in an upper end of the curved sidewalls, each notch having an open end;

a heater coil wound around a wick having first and second ends extending through the first and second notches, respectively;

first and second electrical contacts extending through first and second openings in the base plate, the first and second electrical contacts electrically adjoining first and second ends of the heater coil;

a heater coil housing having complementary first and second notches aligned with the first and second notches in the curved sidewalls of the coil support, the heater coil housing including first and second air inlets through the base plate on opposite sides of the heater coil; and an inner tube in the housing, the inner tube having a first end extending into the heater coil housing.

14. The pod of claim 13 further including a liquid reservoir formed by the base plate and the curved sidewalls, below the heater coil.

15. The pod of claim 13 with the complementary first and second notches of the heater coil housing and the first and second notches in the curved sidewalls of the coil support forming first and second wick ports having a diameter less than the diameter of the wick.

16. The pod of claim 15 with first and second ends of the wick extending out of the first and second wick ports.

17. The pod of claim 13 with the inner tube having sidewalls that flare conically outwardly at a second end of the inner tube.

* * * * *